US011682838B2

(12) United States Patent
Plet et al.

(10) Patent No.: US 11,682,838 B2
(45) Date of Patent: Jun. 20, 2023

(54) MULTIBAND ANTENNA STRUCTURE

(71) Applicant: NOKIA SHANGHAI BELL CO., LTD., Shanghai (CN)

(72) Inventors: Jerome Plet, Louannec (FR); Zied Charaabi, Lannion (FR); Thomas Julien, Lannion (FR); Jean-Pierre Harel, Lannion (FR)

( * ) Notice: Subject to any disclaimer, the term of this patent is extended or adjusted under 35 U.S.C. 154(b) by 135 days.

(21) Appl. No.: 17/256,940

(22) PCT Filed: Jun. 29, 2018

(86) PCT No.: PCT/US2018/040491
§ 371 (c)(1),
(2) Date: Dec. 29, 2020

(87) PCT Pub. No.: WO2020/005299
PCT Pub. Date: Jan. 2, 2020

(65) Prior Publication Data
US 2021/0265731 A1 Aug. 26, 2021

(51) Int. Cl.
*H01Q 5/42* (2015.01)
*H01Q 21/26* (2006.01)
*H01Q 1/24* (2006.01)

(52) U.S. Cl.
CPC ..... *H01Q 5/42* (2015.01); *H01Q 1/24* (2013.01); *H01Q 1/246* (2013.01); *H01Q 21/26* (2013.01)

(58) Field of Classification Search
CPC ..... H01Q 5/42; H01Q 21/26; H01Q 1/246; H01Q 1/24
USPC ..... 343/893
See application file for complete search history.

(56) References Cited

U.S. PATENT DOCUMENTS 6,650,291 B1 * 11/2003 West ..... H01Q 5/40 342/371
6,683,572 B2 1/2004 Abe et al.
6,850,205 B2 2/2005 Yamamoto et al.
6,933,894 B2 * 8/2005 Ghosh ..... H01Q 5/364 343/700 MS
7,450,071 B1 11/2008 Volman
8,368,609 B2 2/2013 Morrow et al.
8,730,110 B2 5/2014 Rao
(Continued)

FOREIGN PATENT DOCUMENTS

CN 1497774 5/2004
CN 1875520 12/2006
(Continued)

*Primary Examiner* — Hai V Tran
(74) *Attorney, Agent, or Firm* — Capitol Patent & Trademark Law Firm, PLLC

(57) ABSTRACT

A multiband antenna structure having an open rectangular box shape is arranged to provide identical electrical lengths for all of its radiating elements notwithstanding that the physical dimensions of portions of the multiband antenna may not be identical. Advantageously, such a multiband antenna may be interleaved with a 5G antenna array having unequal spacing between the 5G antennas or having an offset between at least one of the rows and the columns. This may be achieved by incorporating a dielectric material in at least one radiating element, by forming a radiating element with a serpentine shape, by having a radiating element follow a chicane, by incorporating a reflector of a 5G array, or by employing capacitive coupling.

20 Claims, 13 Drawing Sheets

(56) References Cited

U.S. PATENT DOCUMENTS

| | | | | |
|---|---|---|---|---|
| 9,246,236 | B2 | 1/2016 | Lecam et al. | |
| 9,711,867 | B2 | 7/2017 | Jecko et al. | |
| 2002/0140618 | A1* | 10/2002 | Plet | H01Q 5/42 343/797 |
| 2004/0140942 | A1* | 7/2004 | Gotti | H01Q 13/18 343/810 |
| 2005/0237258 | A1 | 10/2005 | Abramov et al. | |
| 2005/0253769 | A1* | 11/2005 | Timofeev | H01Q 21/08 343/810 |
| 2007/0146225 | A1* | 6/2007 | Boss | H01Q 21/26 343/797 |
| 2009/0278759 | A1* | 11/2009 | Moon | H01Q 5/42 343/810 |
| 2010/0097286 | A1 | 4/2010 | Morrow et al. | |
| 2010/0149061 | A1 | 6/2010 | Haziza | |
| 2011/0063190 | A1* | 3/2011 | Ho | H01Q 21/30 343/912 |
| 2012/0146872 | A1 | 6/2012 | Chainon et al. | |
| 2013/0271336 | A1* | 10/2013 | Plet | H01Q 1/523 343/796 |
| 2016/0248166 | A1 | 8/2016 | Moon et al. | |
| 2017/0133762 | A1 | 5/2017 | Ng et al. | |

FOREIGN PATENT DOCUMENTS

| | | |
|---|---|---|
| CN | 101702467 | 5/2010 |
| CN | 102918705 | 2/2013 |
| CN | 203813033 | 9/2014 |
| CN | 205016677 | 2/2016 |
| EP | 0621653 | 10/1994 |
| EP | 2323217 | 5/2011 |
| EP | 2913893 | 9/2015 |
| EP | 2937933 | 10/2015 |
| EP | 3179634 | 6/2017 |
| GB | 2529885 | 9/2016 |
| JP | 2008042510 | 2/2008 |
| JP | 2012120150 | 6/2012 |
| JP | 2015122557 | 7/2015 |
| KR | 20130134793 | 12/2013 |
| WO | WO2005011057 | 2/2005 |
| WO | WO2007035064 | 3/2007 |
| WO | WO 2011028616 | 3/2011 |
| WO | WO 2012/055883 | 5/2012 |

* cited by examiner

MULTIBAND ANTENNA STRUCTURE

This application claims benefit of International Application Number PCT/US2018/040491 filed on 29 Jun. 2018 entitled MULTIBAND ANTENNA STRUCTURE. The content of the foregoing application is incorporated herein by reference.

TECHNICAL FIELD

This disclosure relates to antennas, and more particularly, to adding a new type of antenna array to be used to provide a wireless service using space already used by an existing antenna array to provide a different wireless service.

BACKGROUND

Acquiring new sites to place the antennas necessary for providing wireless service, especially for a wireless service that requires a new type of antenna, has become almost impossible in most dense urban areas. Also, the addition of new antennas supporting new frequency bands can result in very long, painful, and expensive negotiations with site owners. As a result, the deployment of active antennas systems (AAS), a key enabler of so-called "fifth generation (5G)" wireless service, will likely be a major challenge for mobile network operators. Given the foregoing, it is desirable to find ways to add new antennas onto already crowded sites, especially rooftops.

SUMMARY

In our related concurrently filed patent application U.S. application Ser. No. 17/256,925, which is incorporated herein by reference and referred at times hereafter as "the referenced disclosure", it was recognized the installation issues can be avoided, in accordance with the principles of the referenced disclosure, by the use of an arrangement which interleaves an array of 5G antennas amongst multiband antenna structures. The multiband antenna structures may be passive antennas. In accordance with an aspect of the referenced disclosure, the multiband antenna structures may be low band (LB) antennas. In accordance with an aspect of the referenced disclosure, the 5G antennas may be arranged as a massive multiple-input multiple-output (mMIMO) array. The mMIMO array may be an active array. In such a case, where the 5G antenna array is an active array and the LB antenna array is a passive array, the overall configuration may be referred to as an active passive antenna (APA) arrangement.

As described, such an interleaved arrangement of antennas may employ low band (LB) antennas that are formed using conductive elements, including, for example, feeders and radiators, on thin supporting sheets. The supporting sheets are oriented so that at least one of their dimensions, e.g., their thinnest dimension, fits within the limited physical space between the 5G antennas. One or more of the supporting sheets, which act as a substrate to which the conductive elements are affixed, may be, for example, a printed circuit board. The substrates may be arranged so as to generally appear to form four sides of a hollow rectangular parallelepiped, e.g., four sides of a hollow cuboid, which may have various protrusions and cutouts, where the missing two sides, which are open, may be considered to be the top and bottom sides of the cuboid, where the bottom side is closest to the plane from which the signals are supplied to the antennas. In other words, the substrates for the radiating elements of the LB antennas may be shaped to appear like an empty rectangular box with the top and bottom surfaces removed. The missing bottom surface is in the area from which the 5G antennas receive their signal to transmit, e.g., near the chassis level, and the lack of the opposing top surface allows signals from the 5G antennas to radiate outward.

Herein, the terms top, bottom, horizontal and vertical are to be construed irrespective of the position of the structure in space with respect to a horizontal plane. In particular, the terms horizontal and vertical are to be construed to merely refer to two perpendicular planes in space.

The positions, dimensions, and heights of each LB and 5G radiating element are set based on desired radio frequency (RF) performance of the LB and 5G arrays. Thus, the LB antennas may be thought of as having been "slipped in" amongst a preexisting array of 5G antennas and each LB antenna may surround one or more of the 5G antennas. Portions of one or more of the substrates may be removed or missing.

Although not so limited, in the embodiments shown in concurrently filed patent application U.S. application Ser. No. 17/256,925 the physical dimensions of each of the substrates of at least one of the LB antennas are substantially the same. In other words, the LB antennas, when viewed from the top, appear to be substantially square-like, i.e., having a square cross-section.

The radiating elements of the LB antennas are electrically arranged to form an arrangement of dipoles. These low band (LB) radiating elements may be passive or active, depending on the embodiment.

The 5G antennas may be located atop pillars so as to bring them to an appropriate height, e.g., with respect to the LB antennas. Thus, the 5G antennas may have their tops below, at the same level as, or above the plane of the missing top surface of the LB antennas.

Each 5G antenna may be formed of at least one dipole. In some embodiments, two dipoles oriented at 90 degrees from each other are used to make up the 5G antenna. In embodiments of the referenced disclosure, each 5G antenna may be coupled to a filter. In embodiments of the referenced disclosure, such filters may be incorporated into stands or pillars on which the 5G antennas sit.

Concurrently filed patent application U.S. application Ser. No. 17/256,925 depicts the use of a homogeneous active 5G antenna array, i.e., an array in which the vertical spacing between each 5G radiating element is identified to their horizontal spacing, such as 0.5×0.5 lambda, 0.65×0.65 lambda, and so forth, lambda being an operating wavelength.

However, active antenna arrays often require non-homogeneous topologies, i.e., an array in which the vertical spacing between each 5G radiating element is different from their horizontal spacing, such as 0.5×0.7 lambda. This is mainly due to the fact that horizontal beamsteering capabilities must be wide, typically +/−45° or +/−60°, while the vertical steering features may be somewhat more limited, typically +/−10° or +/−20°. In addition, to increase the overall antenna gain, it may be useful to increase the vertical spacing to 0.7 or 0.8 lambda.

We have recognized that the LB antennas described in currently filed patent application U.S. application Ser. No. 17/256,925 may be inadequate or suboptimal for use with an active antenna array having a non-homogeneous topology. This is because if such an LB antenna must surround active antennas with a non-homogeneous topology it becomes necessary for its vertical and horizontal branches to have different dimensions, e.g., lengths. While with identical dimensions, e.g., so that the LB antenna looks like a square looking toward the surface through which the 5G signal passes, the currents floating on each branch directly reach a balance, as the dimensions change this is no longer the case and dysfunctions may start to appear.

We have recognized that such dysfunctions may be mitigated, in accordance with the principles of the disclosure, by arrangements of the LB antenna which provide identical electrical lengths for the radiating elements notwithstanding the physical dimensions of the LB antenna, e.g., the various portions of its support structure, which may not be identical. Advantageously, such an LB antenna may have unequal physical distances, e.g., so that the LB antenna substantially gives the appearance of a non-square rectangle when looking toward the surface through which the 5G signal passes, while having identical electrical lengths for the radiating elements.

In one embodiment of the disclosure, a dielectric material is incorporated within at least one of the radiating elements.

In one embodiment of the disclosure, at least one of the radiating elements is formed with at least one zigzag conductor.

In one embodiment of the disclosure, at least one chicane is incorporated within at least one of the radiating elements.

In one embodiment of the disclosure, capacitive coupling is incorporated within at least one of the radiating elements.

In one embodiment of the disclosure, at least one at least one of the radiating elements includes a conductor that goes around part of the reflector of at least one of the 5G antennas.

Some embodiments feature an antenna, comprising:

a first set of two parallel, flat generally rectangular substrate panels each having a height, a length, and a thickness, wherein a first conductor having a physical length is extended along the length of a respective panel of the first set such that the conductor of each panel has a resulting electrical length, the panels being separated by a distance shorter than the length of each panel of the first set;

a set of supports, each support of the set of supports supporting a respective second conductor that runs between the first set of panels, each of the second conductors supported by the set of supports running substantially between an edge of a first panel and an edge of a second panel of the first set of panel;

wherein the second conductors supported by the set of supports are arranged to have substantially the same electrical length as each of the first conductors.

In some specific embodiments at least one of the second conductors supported by the set of supports has a dielectric material coupled thereto so as to change its electrical length to be substantially equal to that of at least one of the first conductors.

In some specific embodiments at least one of the second conductors supported by the set of supports has a zig-zag or serpentine shape so that its electrical length is substantially equal to that of at least one of the first conductors.

In some specific embodiments at least one of the set of supports has at least one chicane, at least one of the second conductors supported by the set of supports following the path of the at least one chicane of its support as it runs between the first set of panels so that the electrical length of the second conductor supported by the set of supports including the chicane is substantially equal to that of at least one of the first conductors.

In some specific embodiments at least one of the second conductors supported by the set of supports incorporates a conductor that goes around at least a part of a reflector for a fifth generation-5G-antenna for broadband cellular networks.

In some specific embodiments at least one of the conductors supported by the set of supports is divided into at least two portions, each of the two portions being electrically connected by a conductor that goes around at least a part of a reflector for a fifth generation-5G-antenna for broadband cellular networks.

In some specific embodiments the antenna is a multiband antenna.

In some specific embodiments the multiband antenna is a passive antenna.

In some specific embodiments the multiband antenna is a low band (LB) antenna.

Some embodiments feature a multiband antenna adapted to be interleaved amongst a two dimensional array of fifth generation-5G-antennas, wherein the multiband antenna is shaped substantially like a hollow parallelepiped with two opposing surfaces missing, wherein one of the missing surfaces is proximal to a source of a signal that is supplied to the multiband antenna to be transmitted therefrom and the opposing missing surface is distal to the signal source;

wherein the hollow parallelepiped comprises a first group of two opposing ones of support walls having a thickness that fits within a gap between at least two of the 5G antennas and having a first physical distance between them and a second group of two opposing support walls having a second physical distance between them, the first physical distance being different from the second physical distance;

each of the support walls supporting a conductor for radiating therefrom; and wherein the electrical length of each of the conductors for radiating supported on each respective support wall of the first group of two opposing ones of support walls is adapted to be equal to the electrical length of each of the conductors for radiating supported on each respective support wall of the second group of two opposing ones of support walls.

In some specific embodiments the hollow parallelepiped is a cuboid but not a cube.

The multiband antenna as defined in claim 10 the electrical length of each of the conductors for radiating supported on each respective support wall of the first group of two opposing ones of support walls is adapted by having thereon a dielectric material.

In some specific embodiments the electrical length of each of the conductors for radiating supported on each respective support wall of the first group of two opposing ones of support walls is adapted by having a zig-zag or a serpentine shape.

In some specific embodiments each wall of the first group of two opposing support walls is made up of at least two separate support wall portions having a thickness that fits within a gap between at least two of the 5G antennas and each supporting a portion of the conductor for radiating supported by its respective wall of the first group; and wherein the electrical length of each of the conductor for radiating supported by its respective wall of the first group is adapted by overlapping the portions of the conductor for radiating supported by its respective wall portions.

Some embodiments feature a multiband antenna adapted to be interleaved amongst a two dimensional array of fifth generation (5G) antennas, wherein the multiband antenna is shaped substantially like a hollow parallelepiped with two opposing surfaces missing, wherein one of the missing surfaces is proximal to a source of a signal that is supplied to the multiband antenna to be transmitted therefrom and the opposing missing surface is distal to the signal source;

wherein the hollow parallelepiped comprises a first group of two opposing ones of support walls having a thickness that fits within a gap between at least two of the 5G antennas and having a first physical distance between them and a second group of two opposing support walls having a second physical distance between them, the first physical distance being different from the second physical distance;

each of the support walls supporting a conductor for radiating therefrom;

wherein each wall of the first group of two opposing support walls is made up of at least two support wall portions having a thickness that fits within a gap between at least two of the 5G antennas, each supporting a portion of the conductor for radiating supported by its respective wall of the first group, a gap existing in each supporting wall of the first group between the at least two support wall portions, each gap being bridged by at least one bridging conductor that is included as part of the conductor for radiating supported by its respective wall of the first group; and wherein the electrical length of each of the conductors for radiating supported by each respective support wall of the first group of two opposing ones of support walls is adapted to be equal to the electrical length of each of the conductors for radiating supported on each respective support wall of the second group of two opposing ones of support walls.

In some specific embodiments the hollow parallelepiped is a cuboid but not a cube.

In some specific embodiments the bridging conductor for at least one of the gaps is at least a conductor shaped to go around part of a respective reflector for a 5G antenna entering at least in part into the at least one gap.

In some specific embodiments the bridging conductor for at least one gap is a conductor supported along the contours of a chicane located in the at least one gap.

In some specific embodiments the bridging conductor for at least one gap is a conductor supported along the contours of a chicane located in the at least one gap, the at least one chicane being made up of the same materials as the wall portions.

In some specific embodiments the antennas of the 5G array are arranged in a lattice design.

In some specific embodiments the antennas of the 5G array are arranged in a lattice design such each column is shifted vertically by with respect to its neighboring column.

DETAILED DESCRIPTION

Figure 1:
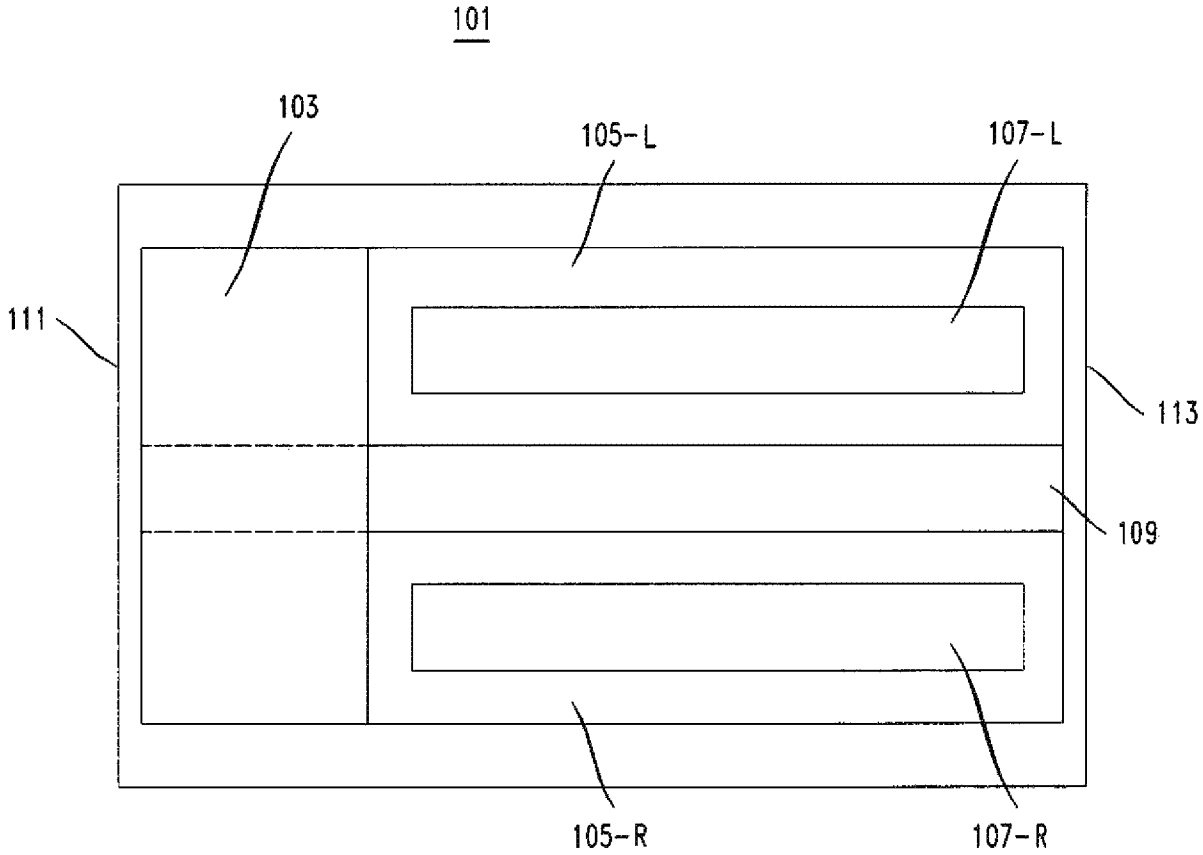
FIG. 1 shows a block representation of a top view of an illustrative antenna frame in accordance with the principles of the disclosure.

The following merely illustrates the principles of the disclosure. It will thus be appreciated that those skilled in the art will be able to devise various arrangements that, although not explicitly described or shown herein, embody the principles of the disclosure and are included within its spirit and scope. Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions. Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future.

It will be appreciated by those skilled in the art that any block diagrams herein represent conceptual views of illustrative circuitry or components embodying the principles of the disclosure.

Unless otherwise explicitly specified herein, the drawings are not drawn to scale. In the description, identically numbered components within different ones of the FIGs. refer to the same components.

The issues of installing new antennas for use on crowded sites, where the new antennas are needed to support a new, such as a next generation, wireless service, e.g., 5G, can be avoided, in accordance with the principles of the referenced disclosure, by the use of an arrangement which interleaves an array of 5G antennas amongst multiband antenna structures. In accordance with an aspect of the referenced disclosure, the multiband antenna structures may be passive antennas. In accordance with an aspect of the referenced disclosure, the multiband antenna structures may be low band (LB) antennas. In embodiments of the referenced disclosure, several of the multiband antenna structures may be arranged to perform within at least one of several bands, e.g., from about 700 MHz to about 960 MHz, from about 1710 MHz to about 2690 MHz and from about 1400 MHz to about 2400 MHz. In accordance with an aspect of the referenced disclosure, the 5G antennas may be arranged as a massive multiple-input multiple-output (mMIMO) array. The mMIMO array may be an active array. In such a case, where the 5G antenna array is an active array and the LB antenna array is a passive array, the section of the overall antenna frame having a configuration with the 5G antenna array within the LB antenna array may be referred to as an active passive antenna (APA) arrangement.

Herein, the term 5G is meant to refer to the next generation of mobile networks as specified by the International Telecommunications Union-Radio communications sector (ITU-R), referred to as 4G standards which is well known to those of ordinary skill in the related art.

In accordance with an aspect of the referenced disclosure, such an interleaved arrangement of antennas may employ low band (LB) antennas that are formed using conductive elements, including, for example, feeders and radiators, on thin supporting sheets. The supporting sheets are oriented so that at least one of their dimensions, e.g., their thinnest dimension, fits within the limited physical space between the 5G antennas. In accordance with an embodiment of the referenced disclosure, one or more of the supporting sheets, which act as a substrate to which the conductive elements are affixed, may be, for example, a printed circuit board. The substrates may be arranged so as to generally appear to form four sides of a hollow rectangular parallelepiped, e.g., four sides of a hollow cuboid, which may have various protrusions and cutouts, where the missing two sides, which are open, may be considered to be the top and bottom sides of the cuboid, where the bottom side is closest to the plane from which the signals are supplied to the antennas. In other words, the substrates for the radiating elements of the LB antennas may be shaped to appear like an empty rectangular box with the top and bottom surfaces removed. The missing bottom surface is in the area from which the 5G antennas receive their signal to transmit, e.g., near the chassis level, and the lack of the opposing top surface allows signals from the 5G antennas to radiate outward. The low band (LB) radiating elements thus fit within the narrow interstices between radiating elements of a two-dimensional 5G antenna array.

FIG. 1 shows a block representation of a top view of an illustrative antenna frame 101 in accordance with the principles of the referenced disclosure. Antenna frame 101 includes: a) interleaved multiband antenna structures+5G radiating antenna structure 103, in accordance with the principles of the referenced disclosure; b) two LB antenna networks 105-L and 105-R, collectively LB antenna networks 105, which operate, for example, from about 0.7 GHz to about 0.96 GHz and which are made up of dual polarization antennas; c) two high band (HB) antenna networks 107-L and 107-R which operate, for example, from about 1.7 GHz to about 2.7 GHz and which are each placed "inside" the respective one of LB antenna networks 105 that has a matching reference designator suffix; and d) one HB antenna network 109 which operates, for example, from about 1.4 GHz to about 2.4 GHz, also known as central passive array 109. All of the networks may be variable electrical tilt (VET) capable. The overall antenna dimensions may be about 2090 mm×499 mm×215 mm. Note that by placed "inside" it is meant in an embodiment of the referenced disclosure that the HB antennas of HB antenna networks 107 may be placed on top of and between the antennas of corresponding LB antenna networks 105. In embodiments of the referenced disclosure, as indicated by the dashed lines, at least one of LB antenna networks 105 may continue all the way across antenna frame 101 by including as elements thereof at least one of the multiband antenna structures that is part of interleaved multiband antenna structures+5G radiating antenna structure 103. Note in this regard that the antenna elements within an LB antenna networks 105 need not all be of the same type or structure. For example, in an embodiment of the referenced disclosure, one of LB antenna networks 105 may be made up of 8 LB elements where one is a patch alone, 5 are a patch with 'L' elements positioned on top of them, and 2 are multiband antenna structures interleaved with 5G dipoles in accordance with the principles of the referenced disclosure. In embodiments of the referenced disclosure, all the antennas of one of LB antenna networks 105 may be fed using the same LB feeding network.

Designs comprising a similar sized chassis and configured similarly except for the space occupied by interleaved LB+5G radiating antenna structure 103 being occupied only by a 2×2 LB antenna arrays, would leave no space on the frame for additional 5G antennas. As such, there is no space, for example, for an additional 8×8×2 3.5 GHz active antenna array, where the "2" indicates that the antennas of the 5G antenna array provide for dual polarization.

Figure 2:
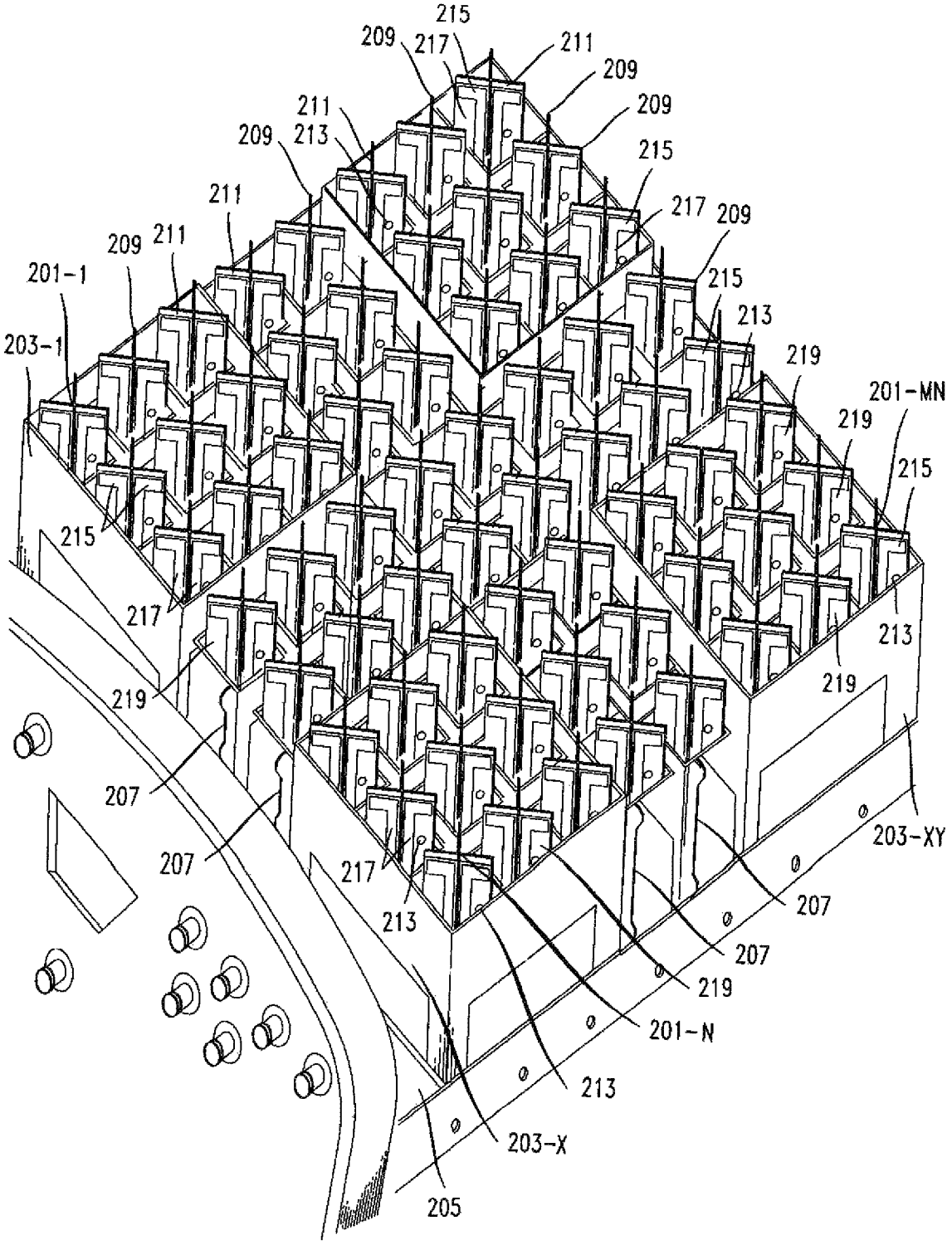
FIG. 2 shows an illustrative perspective view of a section of an interleaved LB+5G radiating antenna structure, in accordance with the principles of the disclosure.

FIG. 2 shows an illustrative perspective view of a section of interleaved LB+5G radiating antenna structure 103, in accordance with the principles of the referenced disclosure. Shown in FIG. 2 are N×M 5G radiating antennas elements 201-1 to 201-NM, which may be referred to individually as a 5G antenna 201 and collectively as 5G antennas 201. This array may be a 5G mMIMO N×M×2 antenna array where N is an integer greater than or equal to 1 that corresponds to the number of columns of antennas, M is an integer greater than or equal to 1 that corresponds to the number of rows of antennas, and 2 corresponds to the number of cross polarized channels per antenna 201, e.g., when each antenna 201 is a dual polarized antenna made up of two dipoles.

In FIG. 2, both N and M are equal to 8, so there are 64 antennas arranged as an 8×8 antenna matrix and when each antenna is a dual polarized antenna the result is a 128 element mMIMO array. The 5G array may be, for example, functional from about 3.3 GHz to about 3.7 GHz or from about 3.4 GHz to about 3.8 GHz. As will be readily understood by those of ordinary skill in the art, other variously dimensioned mMIMO arrays may be employed, e.g., that correspond to other central frequencies, such as, 700 MHz or 2.5 GHz. In accordance with an aspect of the referenced disclosure, the 5G antenna array may be an active antenna array.

Also shown in FIG. 2 is an array of multiband antennas, which, as shown in FIG. 2 are an array of low band antennas 203-1 to 203-XY, where X is an integer greater than or equal to 1 that corresponds to the number of columns of antennas 203 and Y is an integer greater than or equal to 1 that corresponds to the number of rows of antennas 203, which may be referred to individually as an LB antenna 203 and collectively as LB antennas 203. LB antennas 203 may operate from about 0.7 GHz to about 0.96 GHz. As will be readily understood by those of ordinary skill in the art, other frequency bands may be employed. LB antennas 203 are interleaved, or interspersed, amongst 5G antennas 201. Of course, it may be considered that 5G antennas 201 are interleaved or interspersed amongst LB antennas 203.

Advantageously, in accordance with an aspect of the referenced disclosure, LB antennas 203 are designed so that they can fit within the spacing between 5G antennas 201. In the example of the referenced disclosure shown in FIG. 2, antennas 203 have a hollow cuboid shape where two opposing faces of the cuboid are missing. One of the missing faces is proximal to chassis 205 of the antenna frame of which 5G antennas 201 and LB antennas 203 are a part, e.g., the chassis of antenna frame 101 (FIG. 1) while the other missing face is distal to the chassis of the antenna frame, e.g., in the manner shown in FIG. 2. Another way to think about LB antennas 203 is that they are akin to a rectangular ribbon that is added to surround one or more of 5G antennas 201. Thus, LB antennas 203 may be viewed as having been "slipped in" amongst a preexisting array of 5G antennas 201 and each LB antenna 203 surrounds one or more of 5G antennas 201.

LB antennas 203 are arranged in a 2×2 array in the embodiment of the referenced disclosure shown in FIG. 2. In embodiments of the referenced disclosure, the physical dimensions of each of the LB antennas 203 may be substantially the same, e.g., in the manner shown in FIG. 2. In the illustrative embodiment of FIG. 2, there are nine 5G antennas within the space defined by one of LB antennas 203. In the embodiment of FIG. 2, there are also two rows of three 5G antennas between each adjacent pair of LB antennas 203.

In an embodiment of the referenced disclosure to be discussed in conjunction with FIG. 2, 5G antennas 201 are configured to form an active array while LB antennas 203 are employed as a passive array. As noted above, such a configuration may be referred to as an active passive antennas (APA) arrangement. However, as will be recognized by those of ordinary skill in the art, such need not be a limitation but rather 5G antennas 201 may be used passively while LB antennas 203 may be used actively. The various possible combinations and arrangements are at the implementer's discretion.

Advantageously, the interleaved antenna array structure can be used as a replacement for a previously installed antenna array of the same size while providing enhanced or additional functionality. Thus, interleaved LB+5G radiating antenna structure 103 can be substituted in a place on a chassis that previously only had an LB antenna array. This allows an active 5G functionality to be added to a frame without losing the previously only available LB functionality that was located within the space that now provides the 5G functionality.

One type of antenna radiating element that is generally suitable to be used as 5G antennas is generally described in United States Patent Publication 2012/0146872 of Chainon et al. which was published on Jun. 14, 2012 and is incorporated herein by reference. As will be readily understood by those of ordinary skill in the art, other types of antennas, including patch, other configurations of dipoles, or any other high band antenna and even combinations thereof, may be employed as the 5G antennas.

In accordance with an aspect of the referenced disclosure, 5G antennas 201 may be located atop pillars, e.g., pillars 207 so that they are offset from chassis 205 so as to bring them to an appropriate height, e.g., with respect to the "tops" of LB antennas 203, which are the portions thereof distal from chassis 205. Thus, the 5G antennas may have their "tops" below, at the same level as, or above the plane of the missing top surface of LB antennas 203. Each of pillars 207 couples signals between 5G antennas 201 and radio circuitry (not shown) that may be located below chassis 205. Advantageously, the array of 5G antennas 201 may be placed to best effect, e.g., to minimize potential radio frequency (RF) interactions between the 5G antennas 201 and any other antenna arrays existing within the same overall antenna envelope at the site. Although often convenient or advantageous to be so arranged, not all of 5G antennas 201 need be at the same height.

In accordance with an aspect of the referenced disclosure, filter elements may be added to each of the antennas, or subgroups of antennas, in order to prevent potential damaging interactions from any existing radio networks with 5G antennas 201, as well as, or in the alternative, to protect any existing radio networks from potential spurious energy that might be emitted or received by 5G antennas 201. In accordance with a further aspect of the referenced disclosure, such filter elements may be incorporated into pillars 207.

Figure 5:
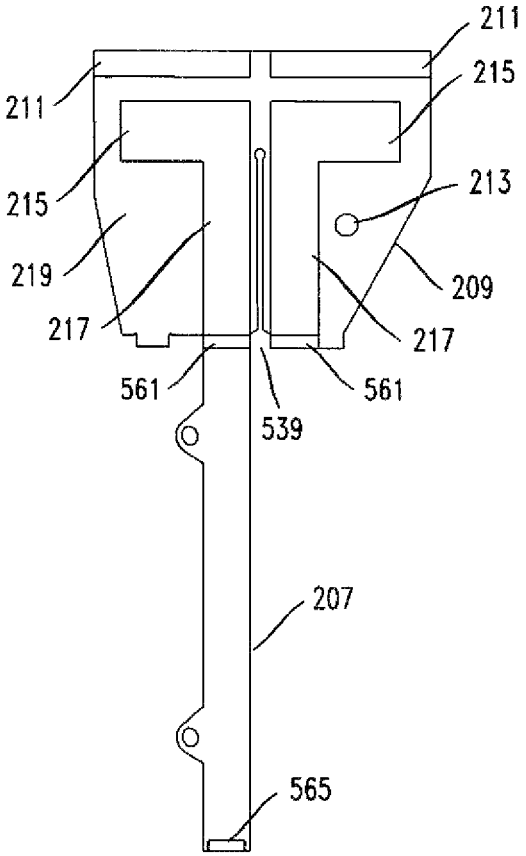
FIGS. 5 and 6 show first and second faces of a circuit board on which is formed a dipole antenna that is part of a 5G antenna along with a portion of a stand.

Each of antennas 201 in the embodiment of FIG. 2 may be a dual polarized structure composed of two dipoles. Each dipole may be formed on a circuit board 209 and two circuit boards are coupled together, e.g. at 90 degree angles, e.g., by using slits in one or more of the circuit boards to fit them together, which is well-known. Such slits, are shown more clearly in FIGS. 5-8, e.g., slit 539 shown in FIGS. 5 and 6, and slit 739 shown in FIGS. 7 and 8. Due to the perspective of FIG. 2, only one of the two circuit boards 209 that make up each dipole is easily visible while the other of the two circuit boards is only seen edge on. Furthermore, for each antenna 201 FIG. 2 only shows one of the faces, face 219, of each of the clearly visible circuit boards 209. Face 219 is also shown in FIG. 5. The opposite face of the clearly visible circuit boards 209 is shown in FIGS. 3 and 6 and discussed hereinbelow.

Face 219 of each of circuit boards 209 that is shown in FIG. 2 and FIG. 5 has thereon a pair of conductors 215 that act as radiating elements, and hence may be referred to as 5G radiating elements 215, and together each pair of conductors 215 makes up a dipole antenna. More specifically, each pair of conductors 215 defines a radiating line. Each of 5G radiating elements 215 is electrically coupled to one of conductors 217. Coupled 5G radiating elements 215 and conductors 217 may be oriented at right angles to each other. This may form an "L" shape that is upside down, or reversed and upside down, given the orientation of FIGS. 2 and 5 with respect to chassis 205, which is considered to be on the bottom. Each of conductors 217 may be considered a base and conductors 215 may be considered an arm.

Figure 7:
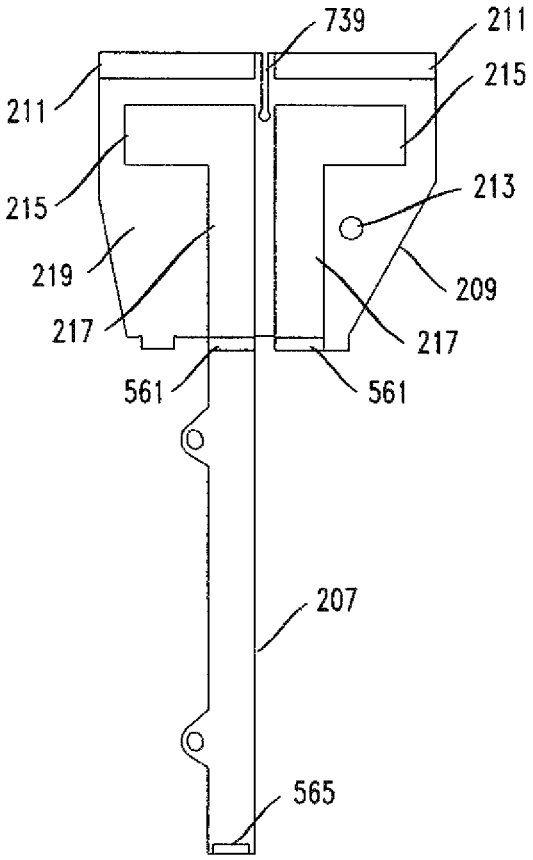
FIGS. 7 and 8 show first and second faces of a circuit board on which is formed a dipole antenna that is part of a 5G antenna along with a portion of a stand, the circuit board of FIGS. 7 and 8 being suitable to be mated orthogonally to the circuit board of FIGS. 5 and 6.

Both of conductors 217 are electrically coupled to ground. The ground is fed via a pillar 207 from a ground plane on chassis 205. Such a ground plane is seen in FIG. 4. One of conductors 217 may be electrically coupled to a pillar 207 at one of connection points 561 (FIGS. 5 and 7). Connection points 561 also couple pillar 207 and conductors 217 to a reflector discussed hereinbelow in connection with FIG. 3, which thus acts as a ground plane.

Figure 6:
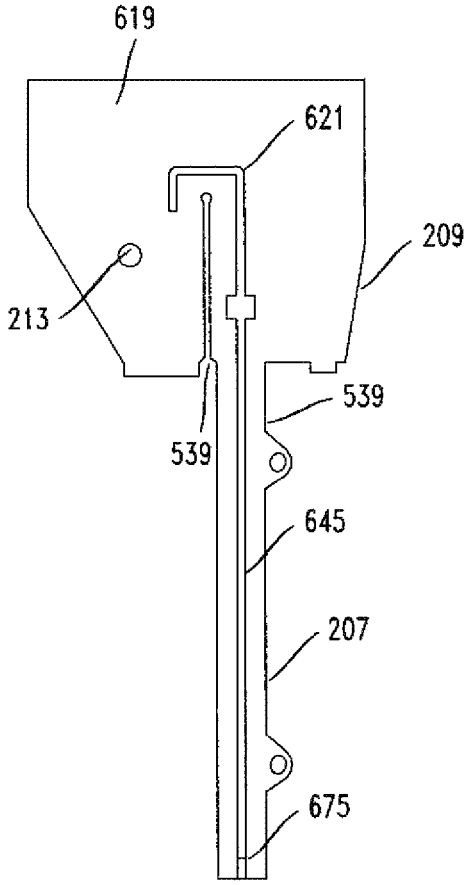

On the face of a circuit board 209 opposite to face 219, which is shown in FIG. 6 as face 619, is conductive line 621 that feeds the dipole made of the two 5G radiating elements 215. Conductive line 621 is shaped like an upside-down "J" so that it crosses over the gap between paired radiating elements 215 on opposite face 219. Conductive line 621 may be fed from stripline 645 via its pillar 207. As can be seen in FIG. 6, conductive line 621 is electrically coupled to stripline 645, e.g., using a solder connection or other such well known method.

Thus, together, 5G radiating elements 215 make up a half-wave dipole made up of two half-dipoles separated by a gap which may be at least partially a slot. The dipole may be a stripline dipole.

Optional conductors 211 may be formed above 5G radiating elements 215 on each of circuit boards 209. Each of conductors 211 is not electrically connected to the dipole formed by the pair of radiating elements 215 on the same one of circuit boards 209 on which they are formed. Conductors 211 form another radiating line that is used to increase the gain and bandwidth of the dipole that is formed on the same one of circuit boards 209 with them. Conductors 211 may thus make up an optional so-called "director" or parasitic part that can be used for pattern shaping and for radiating element impedance matching. It is easier to see conductors 211 in FIGS. 5 and 7.

Holes 213 may be used to visibly distinguish between the two conductors.

Figure 8:
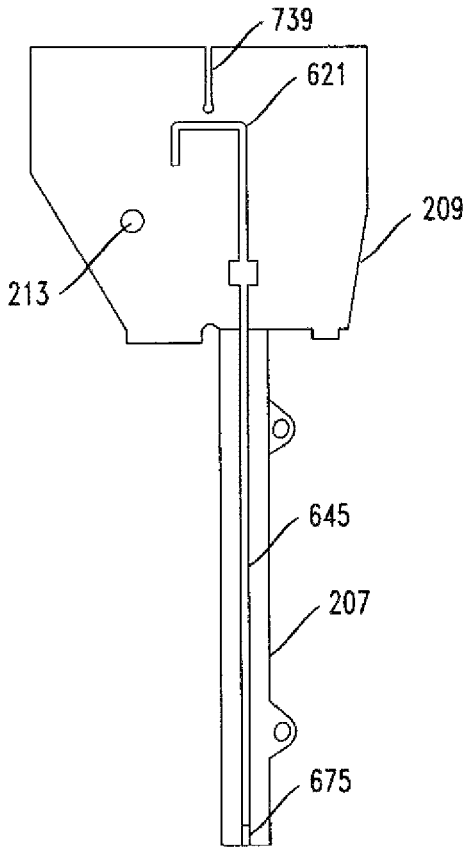

Each of circuit boards 209 that are only seen in FIG. 2 edge on may have a similar structure as described above for the easily visible circuit boards 209. As such, together two coupled orthogonal circuit boards 209 thus make up two dipoles that cross one another at ±45 degree orthogonal polarization. More specifically, FIGS. 7 and 8 show front and rear views of circuit boards 209 that are only seen in FIG. 2 edge on. The structures are substantially the same but for the location of their respective slit.

In one embodiment of the referenced disclosure, the height of circuit boards 209 may be approximately 42 mm while their width is about 48 mm.

Figure 3A:
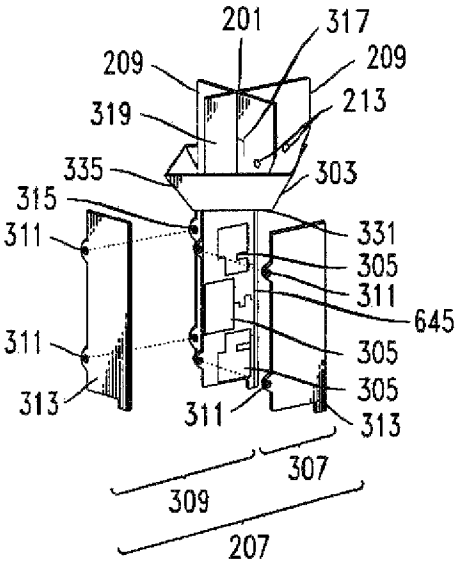
FIG. 3 is made up of FIGS. 3A, 3B, and 3C, each of which shows a different perspective view of an illustrative one of a 5G antenna when mounted on at least one pillar.
Figure 3B:
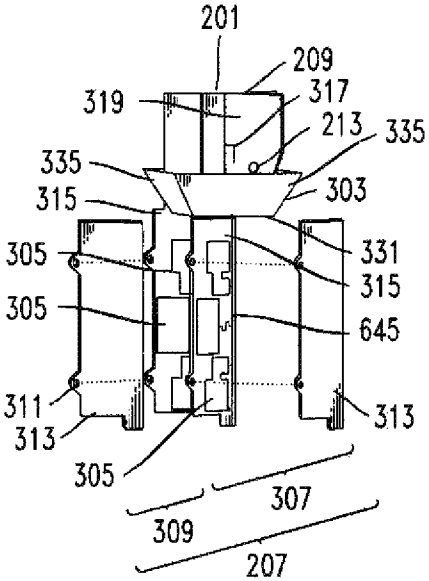
Figure 3C:
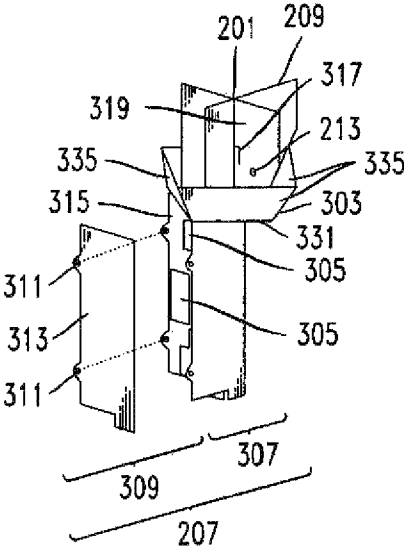
Figure 4:
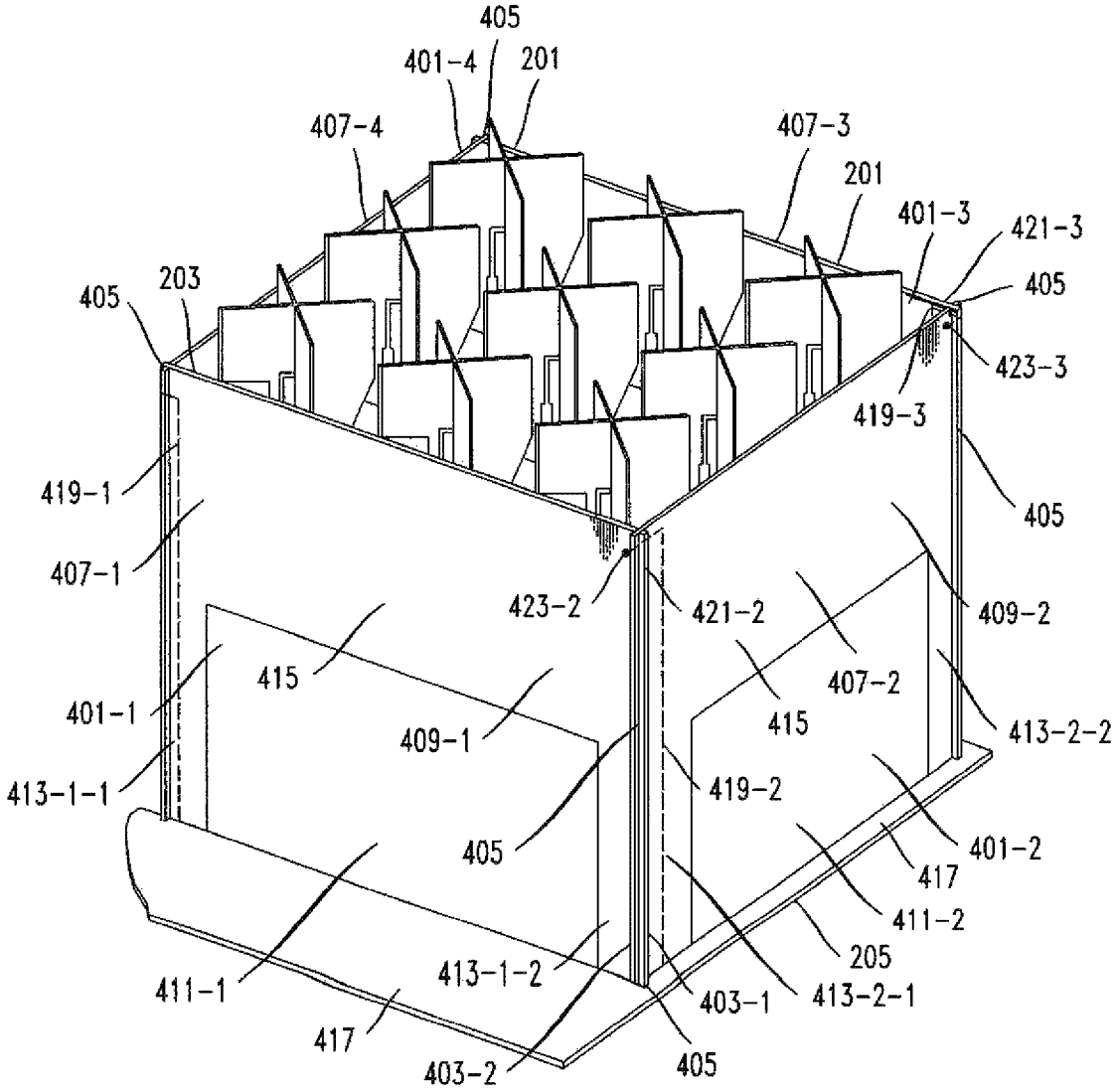
FIG. 4 shows an enlarged view of the structure of an illustrative LB antenna mounted on a chassis.

FIG. 3 is made up of FIGS. 3A, 3B, and 3C, each of which shows a different perspective view of an illustrative one of 5G antennas 201 when mounted on at least one pillar 207 which may also be referred to as a stand 207. The views of FIG. 3 enable seeing the opposite face of circuit boards 209 from face 219 shown in FIG. 2, e.g., face 619 of FIG. 6. For clarity and focus purposes, not all the details of 5G antennas 201 are shown in FIG. 3. As noted, the dipole is fed by conductive line 621 which is on the opposite face of circuit boards 209 from face 219. Portion 317 of conductive line 621 is shown in the views of FIG. 3.

Below antenna 201 is reflector 303. In the illustrative embodiment shown in FIG. 3, reflector 303 has, in the manner shown, an open at its base, hollow, inverted, and truncated pyramidal shape. Flat portion 331 of reflector 303 may be a circuit board covered in a conductor. Angled sides 335 of the pyramid of reflector 303 may be made of conductive metal. Sides 335 may be one or more pieces of metal that are clipped together. Sides 335 of the pyramid may be electrically coupled to the conductor of circuit board 331 of reflector 303. Circuit board 331 may be coupled to ground via connection to the ground on pillars 207 at connection points 561 (FIGS. 5 and 7). Thus, reflector 303 may be grounded in its entirety.

One or more of pillars 207 may be used to provide a signal to be transmitted by 5G antenna 201 from the level of chassis 205 (FIG. 2) to antenna 201. Each pillar 207 may be made up of two half-stands 307 and 309 which in turn may each be made up of two printed circuit boards 313 and 315, each of which has one internal side face facing the other and one external side face that faces outwards when the half stands are assembled. Circuit boards 313 and 315 may be, for example, Taconic TLX PCBs, which are coupled together at holes 311, e.g., using glue, rivets, or some other suitable arrangement, as is known to those of ordinary skill in the art.

The external facing side of printed circuit boards 313 may be coated in a conductor, e.g., copper, to provide an electromagnetic shield. Similarly, the external facing side of printed circuit boards 315 may be coated in a conductor, e.g., copper, to provide an electromagnetic shield. This is also shown in the embodiments shown in FIGS. 5 and 7. Also shown in the embodiments of FIGS. 5 and 7 is connection point 565 at which the conductor is electrically connected to ground, e.g., a ground plane, which is shown in FIG. 4. The internal side of printed circuit boards 313 may just be printed circuit board material. The internal side of printed circuit boards 315 may contain one or more conductors, e.g., stripline 645 (FIGS. 6 and 8), that may act as a feed for the signal to be transmitted by the 5G antenna 201 atop the stand. A connection point for stripline 645 with a signal from a signal source, which may be located below the ground plane, may be connection points 675 as shown in FIGS. 6 and 8. In the embodiments shown in FIGS. 6 and 8, the circuit board of pillar 207 on which connection points 675 are located may extend to below the ground plane shown in FIG. 4.

In an embodiment of the referenced disclosure, e.g., as shown in FIG. 3, various filter elements 305 may be included on the internal surface of printed circuit boards 315 as part of stand 207. These filter elements may provide filtering, e.g., band pass (BP) filtering, for the supplied signals. Filter elements 305 may be a conductive, e.g., copper, regions on printed circuit boards 315.

In the embodiment shown, the filter is a 3 pole band pass stripline filter. The overall dimensions of the BP filter are about 60 mm×24 mm and based on the use of a sandwich of two Taconic TLX PCBs making up half stands 307 and 309 used as part of stand 207 where each PCB has a 0.762 mm thickness. A signal to be transmitted by an antenna 201 may be fed thereto, e.g., by stripline 645, that runs from the bottom of printed circuit boards 315 and is electrically coupled to a signal source which may be located below a ground plane that is on chassis 205. Again, such a ground plane is seen in FIG. 4.

In an alternative embodiment, a printed circuit board that has internal conductive planes available to it may be used in lieu of two separate printed circuit boards. For example, the outer two conductive planes may be used as ground planes while an internal conductive plane can be used for the feed line and filters.

Other types of filtering elements such as are known to those in the art may be employed on, within, or mounted to the pillars. For example, air cavity filters or ceramic filters may be employed. However, such filters typically add additional cost.

The design of such filtering elements must take into consideration several challenges including: 1) the fact that the number of radiating elements required may be very large; 2) the mechanical dimension of each filter element should be minimized while providing good RF performance; and 3) each filter needs to be connected directly to its respective radiating element port. Note that, for example, an 8×8 antenna array in which each radiating element is operating in dual polarization mode potentially leads to the use of, for example, 8×8×2=128 filters. Those of ordinary skill in the art will be able to select or design appropriate filters for their particular application.

Other types of antennas, stands, filters, and reflectors may be employed, without departing from the scope of the disclosure.

FIG. 4 shows an enlarged view of the structure of an illustrative LB antenna 203 (FIG. 2) mounted on chassis 205. In accordance with an aspect of the referenced disclosure, LB antenna 203 may be a passive LB antenna. Also shown are ones of 5G antennas 201 that are located within LB antenna 203, in accordance with the principles of the referenced disclosure. The faces of 5G antennas 201 shown in FIG. 4 are the opposite faces from those shown in FIG. 2 and so are better seen in FIGS. 6 and 8. For clarity and focus purposes, not all the details of 5G antennas 201 are shown in FIG. 4.

LB antenna 203 as shown in FIG. 4 maybe made of four printed circuit boards (PCBs) 401-1 through 401-4, collectively circuit boards (PCBs) 401. PCBs 401 thus make up support walls for the radiating elements of LB antenna 203 and also may at least partially be used to support a feed structure to supply one or more signals to the radiating elements. Ones of printed circuit boards 401 may be interlocked at or near their respective edges. For example, a slit may be made in one of circuit boards 401 and an end portion of another, adjacent, one of circuit boards 402 passed there through. Thus, for example, end portion 403-1 of PCB 401-1 extends past the plane of PCB 401-2 while end portion 403-2 extends past the plane of PCB 401-1. Such, or similar techniques may be used at each corner 405 of LB antenna 203.

Although PCBs have been described hereinabove as the substrate, note that in other embodiments of the referenced disclosure, any dielectric material, e.g., ceramic, glass, plastic, and so forth, that could be properly shaped and support properly shaped conductors may be employed as the substrate.

Portions of ones of external surfaces 407-1 through 407-4, i.e., external to the box, of respective ones of PCBs 401 are coated in a conductive material, e.g., copper. Thus, in the embodiment shown in FIG. 4, inverted "U" shaped conductors 409-1 through 409-4, collectively conductors 409, are formed on external surfaces 407-1 through 407-4 of respective ones of PCBs 401-1 through 401-4. Each of conductors 409 is made up of leg portions 413 and a radiating portion 415. More specifically, each conductor has two leg portions designated by an additional reference designation suffix. Thus, conductor 409-1 has leg portions 413-1-1 and 413-1-2 and radiating portion 415-1. Clearly depicted in FIG. 4 are conductors 409-1 and 409-2. However, note that, due to the orientation of LB antenna 203 in FIG. 4, surfaces 407-3 and 407-4, although they can be indicated, are not clearly visible and so conductors 409-3 and 409-4 are not visible in FIG. 4. Nevertheless, for purposes of the embodiment shown in FIG. 4, they each have thereon the same conductor structure as conductors 409-1 and 409-2.

Portions 411 of each of PCBs 401 that are not coated in conductive material are not necessary and may be eliminated, e.g., to reduce weight. Again, note that due to the orientation of LB antenna 203 removal of such unused portions of PCBs 401-3 and 401-4 could not be seen in FIG. 4 were such to be the case.

FIG. 4 also shows the upper portion of chassis 205, which may be ground plane 417. Such a ground plane was mentioned earlier. Various vias may be made through chassis 205 and ground plane 417 to enable signals to pass through to 5G antennas 201 and LB antennas 203.

Each of leg portions 413 of conductors 409 proximal to ground plane 417 is connected to ground plane 417.

On the rear face of PCBs 401 from leg portions 403, i.e., on the face opposite to conductors 409 which is interior to the box, is located one of conductive lines 419 that is used to feed signals to be radiated by LB antenna 203. Conductive lines 419 are shown dashed to indicate that they are on the rear, internal face and cannot be seen in the view of FIG. 4 due to its perspective except for the small portion of conductive line 419-3. Conductive line 419-1 is located behind leg 413-1-1, conductive line 419-2 is located behind leg 413-2-1, conductive line 419-3 is located behind leg 413-3-1 (not visible), and conductive line 419-4 (not visible) is located behind leg 413-4-1 (not visible).

Near the top of the one of PCBs 401, each of conductive lines 419 bends, e.g., at substantially 90 degrees, and extends to form arm portion 421 that extends toward the edge of the one of PCBs 401 on which it is formed. As such, arm portion 421 may extend through the interlocking adjacent one of PCBs 401. Arm portion 421 is then electrically coupled to conductor 409 of the adjacent, interlocked PCB 401 typically in the upper corner, e.g., at electrical coupling point 423. The electrical coupling may be by way of solder joint, via, conductive glue, or any similar or well known technique. Note that conductors 409 of adjacent PCBs 401 are not electrically connected in that there is no conductor between them. As an example, note that conductive line 419-2 is located behind leg 413-2-1. At the top of PCB 401-2 it bends towards PCB 401-1 through which it extends and is coupled to conductor 409-1 at electrical coupling point 423-3.

In an embodiment of the referenced disclosure, each of conductive lines 419-1 and 419-3 may be coupled to the same signal source which may be located below the surface of chassis 205. Similarly, each of conductive lines 419-2 and 419-4 may be coupled to the same signal source which is different from the signal source coupled to conductive lines 419-1 and 419-3 but which may also be located below the surface of chassis 205. Thus, a dual polarized dipole is formed. Each of the individual dipoles so formed have a plus or minus 45 degree polarization.

Advantageously, due to the thinness of the walls, e.g., PCBs 401, upon which the conductive and radiating elements of LB antenna 203 are supported, the walls, and hence the conductive and radiating elements, can be fit in the interstitial spacing between adjacent ones of 5G antennas 201. This enables an efficient use of space, as a two-dimensional array of 5G antennas 201 can be interleaved among a two-dimensional array of LB antennas 203, e.g., as shown in FIG. 2, in accordance with the principles of the referenced disclosure.

Herein, the term two-dimensional with regard to an array of antennas is to be understood to refer to the dimensions that form the array, for example in columns and rows, even though the elements forming such arrays, e.g. individual antenna structures present in the rows and columns, have three dimensions.

Figure 9:
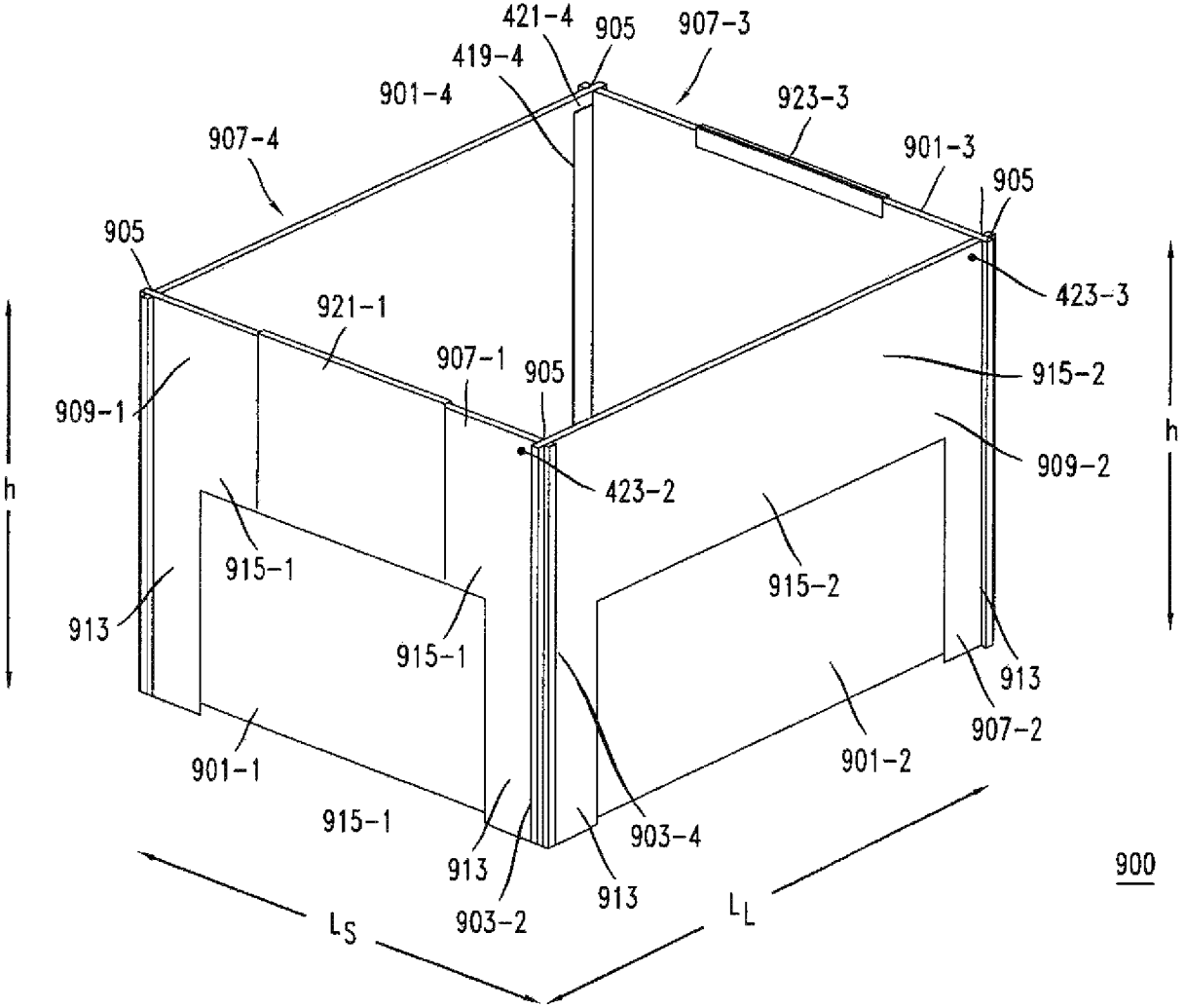
FIG. 9 shows an enlarged view of the structure of an illustrative LB antenna in which the vertical and horizontal branches, i.e., the physical support structure thereof, have different physical dimensions, e.g., lengths, but which have been arranged, in accordance with the principles of the disclosure, to have identical electrical lengths for their radiating elements by adding a dielectric material on top of the shorter radiating elements thereby artificially increasing their electrical lengths.

FIG. 9 shows an enlarged view of the structure of an illustrative LB antenna 900 in which the vertical and horizontal branches, e.g., the physical wall thereof, have different physical dimensions, e.g., lengths, but which have been arranged, in accordance with the principles of the disclosure, to have identical electrical lengths for the radiating elements notwithstanding the different physical dimensions of LB antenna 900, e.g., the various portions of its support structure. In other words, LB antenna 900 may have unequal physical dimensions distances, e.g., so that the LB antenna substantially gives the appearance of a non-square rectangle when looking toward the surface through which the 5G signal passes, while having identical electrical lengths for its radiating elements, in accordance with the principles of the disclosure. In accordance with an embodiment of the disclosure, to increase the electrical length of the shorter radiating elements a dielectric material is added on top of the shorter radiating elements thereby artificially increasing their electrical lengths.

In accordance with an aspect of the disclosure, LB antenna 900 may be a passive LB antenna.

Structured similar to LB antenna 203 (FIG. 4), LB antenna 900 as shown in FIG. 9 may be made of four printed circuit boards (PCBs) 901-1 through 901-4, collectively circuit boards (PCBs) 901. PCBs 901 thus make up support walls for the radiating elements of LB antenna 900 and also may be used to at least partially support a feed structure to supply one or more signals to the radiating elements. Ones of printed circuit boards 901 may be joined or interlocked at their respective edges. For example, a slit may be made in one of circuit boards 901 and an end portion of another one of circuit boards 902 passed there through. Thus, for example, end portion 903-1 of PCB 901-1 extends past the plane of PCB 901-2 while end portion 903-2 extends past the plane of PCB 901-1. Such, or similar techniques may be used at each corner 905 of LB antenna 900.

Portions of ones of external surfaces 907-1 through 907-4 of respective ones of PCBs 901 are coated in a conductive material, e.g., copper. Thus, in the embodiment shown in FIG. 9, inverted "U" shaped conductors 909 are formed on surfaces 907-1 through 907-4 of respective ones of PCBs 901-1 through 901-4. Conductors 909 are made up of leg portions 913 and radiating portions 915. Clearly depicted in FIG. 9 are conductors 909-1 and 909-2. However, note that due to the orientation of LB antenna 900 in FIG. 9 that surfaces 907-3 and 907-4, although they can be indicated, are not clearly visible and so conductors 909-3 and 909-4 are not visible in FIG. 9. Nevertheless, for purposes of the embodiment shown in FIG. 9, they each have thereon the same conductor structure as conductors 909-1 and 909-2, respectively.

In the embodiment shown in FIG. 9, PCBs 901-1 through 901-4 may have the same height h and thickness. However, long sides 901-2 and 901-4 each have length $L_L$ which is greater than the length $L_S$ of each of short sides 901-1 and 901-3. As such, without modification, radiating portions 915-1 and 915-3 (not visible but mounted on PCB 901-3) would have different, shorter electrical lengths than radiating portions 915-2 and 915-4 (not visible but mounted on PCB 901-4). To equalize the electrical lengths of the short sides with those of the long sides, in accordance with an aspect of the disclosure, dielectric material portions 921-1 and 921-3 is added on top of radiating portions 915-1 and 915-3 to artificially increase their electrical lengths. The amount of dielectric material employed is such as to substantially equalize the electrical lengths of each of short sides 901-1 and 901-3 with those of long sides 901-2 and 901-4. Dielectric material portions 921, may be made of any appropriate dielectric material. In one embodiment of the disclosure the dielectric material may be, for example, polyphenylene sulfide (PPS). Dielectric material portions 921 may be shaped in inverted "J" shape in the manner shown so as to be suspended from PCBs 901-1 and 901-3. Other methods for keeping dielectric portions 921 in place, e.g., glue, fasteners, crimping, or the like, may also be employed.

LB antenna 900 may be electrically driven in the same manner as described hereinabove with regard to LB antenna 203. However, except for conductive line 419-4 and arm portion 421-4, in FIG. 9 the remaining driving structure is either not visible or not shown for clarity purposes.

Figure 10:
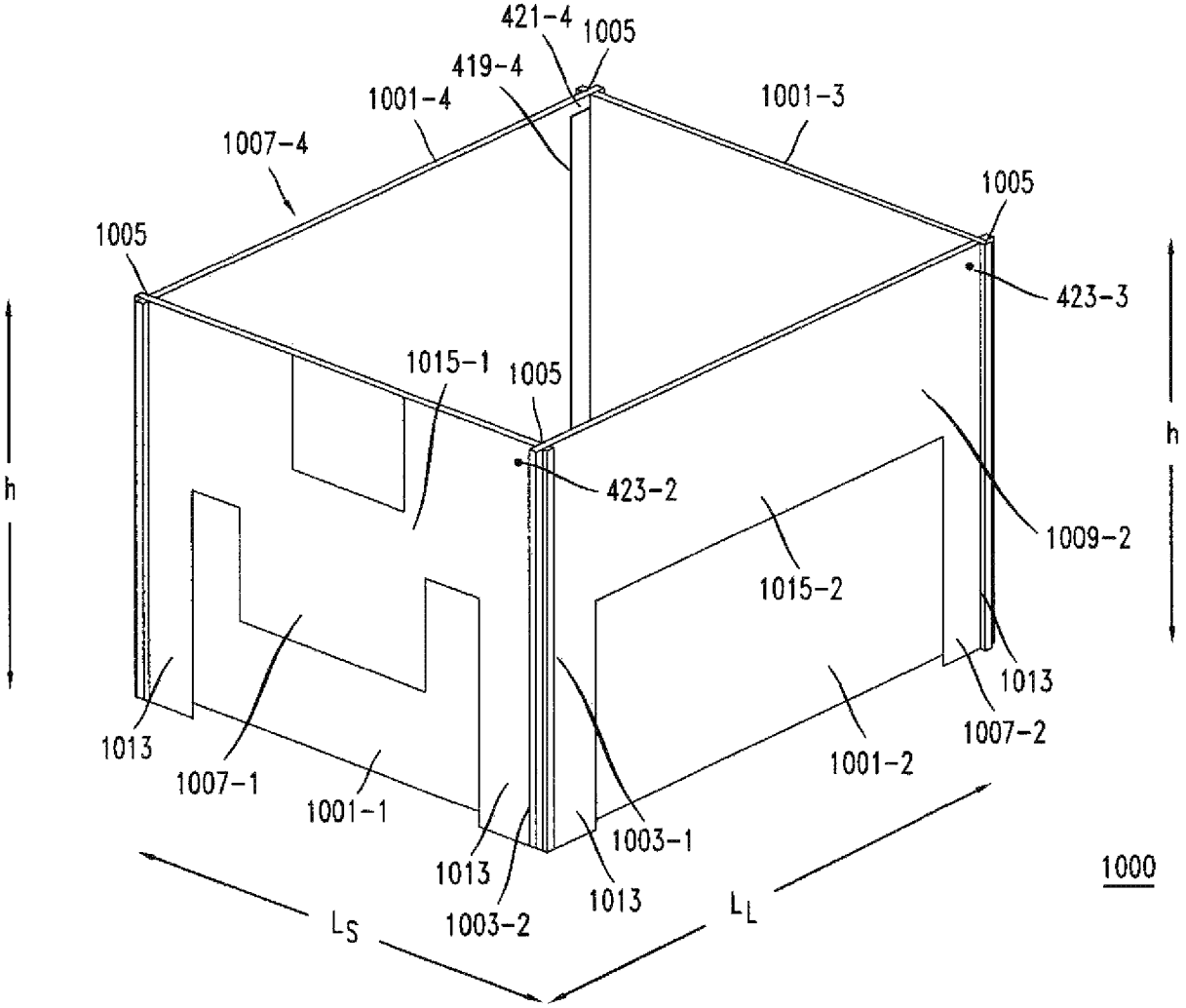
FIG. 10 shows an enlarged view of the structure of an illustrative LB antenna in which the vertical and horizontal branches, i.e., the physical support structure thereof, have different physical dimensions, e.g., lengths, but which have been arranged, in accordance with the principles of the disclosure, to have identical electrical lengths for their radiating elements by increasing the electrical length of the radiating elements running along the physically shorter portion of the support structure by giving them a zig-zag or serpentine shape, thereby artificially increasing their electrical length.

FIG. 10 shows an enlarged view of the structure of an illustrative LB antenna 1000 which is similar to illustrative LB antenna 900 in that the vertical and horizontal branches, i.e., the physical support structure thereof, have different physical dimensions, e.g., lengths, but which have been arranged, in accordance with the principles of the disclosure, to have identical electrical lengths for the radiating elements notwithstanding the different physical dimensions of LB antenna 1000, e.g., the various portions of its support structure. In other words, LB antenna 1000 may have unequal physical dimensions, e.g., so that the LB antenna substantially gives the appearance of a non-square rectangle when looking toward the surface through which the 5G signal passes, while having identical electrical lengths for its radiating elements, in accordance with the principles of the disclosure. In accordance with an embodiment of the disclosure, to increase the electrical length of the radiating elements running along the physically shorter portion of the support structure, each such conductor is arranged to have a zig-zag or serpentine shape, thereby artificially increasing its electrical length.

In accordance with an aspect of the disclosure, LB antenna 1000 may be a passive LB antenna.

Structured similar to LB antenna 203 (FIG. 4), LB antenna 1000 as shown in FIG. 10 may be made of four printed circuit boards (PCBs) 1001-1 through 1001-4, collectively circuit boards (PCBs) 1001. PCBs 1001 thus make up support walls for the radiating elements of LB antenna 1000 and also may be used to at least partially support a feed structure to supply one or more signals to the radiating elements. Ones of printed circuit boards 1001 may be joined or interlocked at their respective edges. For example, a slit may be made in one of circuit boards 1001 and an end portion of another one of circuit boards 1002 passed there through. Thus, for example, end portion 1003-1 of PCB 1001-1 extends past the plane of PCB 1001-2 while end portion 1003-2 extends past the plane of PCB 1001-1. Such, or similar techniques may be used at each corner 1005 of LB antenna 1000.

Portions of ones of external surfaces 1007-1 through 1007-4 of respective ones of PCBs 1001 are coated in a conductive material, e.g., copper. Thus, in the embodiment shown in FIG. 10, inverted "U" shaped conductors 1009 are formed on surfaces 1007-2 and 1007-4 of respective ones of PCBs 1001-2 and 1001-4. Conductors 1009 are made up of leg portions 1013 and radiating portions 1015. Clearly depicted in FIG. 10 is conductor 1009-2. However, note that due to the orientation of LB antenna 1000 in FIG. 10 that surface 1007-4, although it can be indicated, is not clearly visible and so conductor 1009-4 is not visible in FIG. 10. Nevertheless, for purposes of the embodiment shown in FIG. 10, it has thereon the same conductor structure as conductor 1009-2.

In the embodiment shown in FIG. 10, PCBs 1001-1 through 1001-4 may have the same height, h, and thickness. However, long sides 1001-2 and 1001-4 each have length $L_L$ which is greater than the length $L_S$ of each of short sides 1001-1 and 1001-3. As such, had they been similarly shaped to radiating portions 1015-2 and 1015-4, radiating portions 1015-1 and 1015-3 (not visible but mounted on PCB 1001-3) would have different electrical lengths than radiating portions 1015-2 and 1015-4 (not visible but mounted on PCB 1001-4). To equalize the electrical lengths of the short sides with those of the long sides, in accordance with an aspect of the disclosure, the shape of radiating portions 1015-1 and 1015-3 is modified to increase their electrical lengths. To this end, a serpentine or zig-zag shape may be employed, e.g., in the manner shown in FIG. 10. Those of ordinary skill in the art will readily be able to design a shape having the desired electrical length. Note that radiating portions 1015-1 and 1015-3 are electrically connected to leg portions 1013 on PCBs 1001-1 and 1001-3 which are the same as leg portions 1013 on PCBs 1001-2 and 1001-4.

LB antenna 1000 may be electrically driven in the same manner as described hereinabove with regard to LB antenna 203. However, except for conductive line 419-4 and arm portion 421-4, in FIG. 10 the remaining driving structure is either not visible or not shown for clarity purposes.

Figure 11:
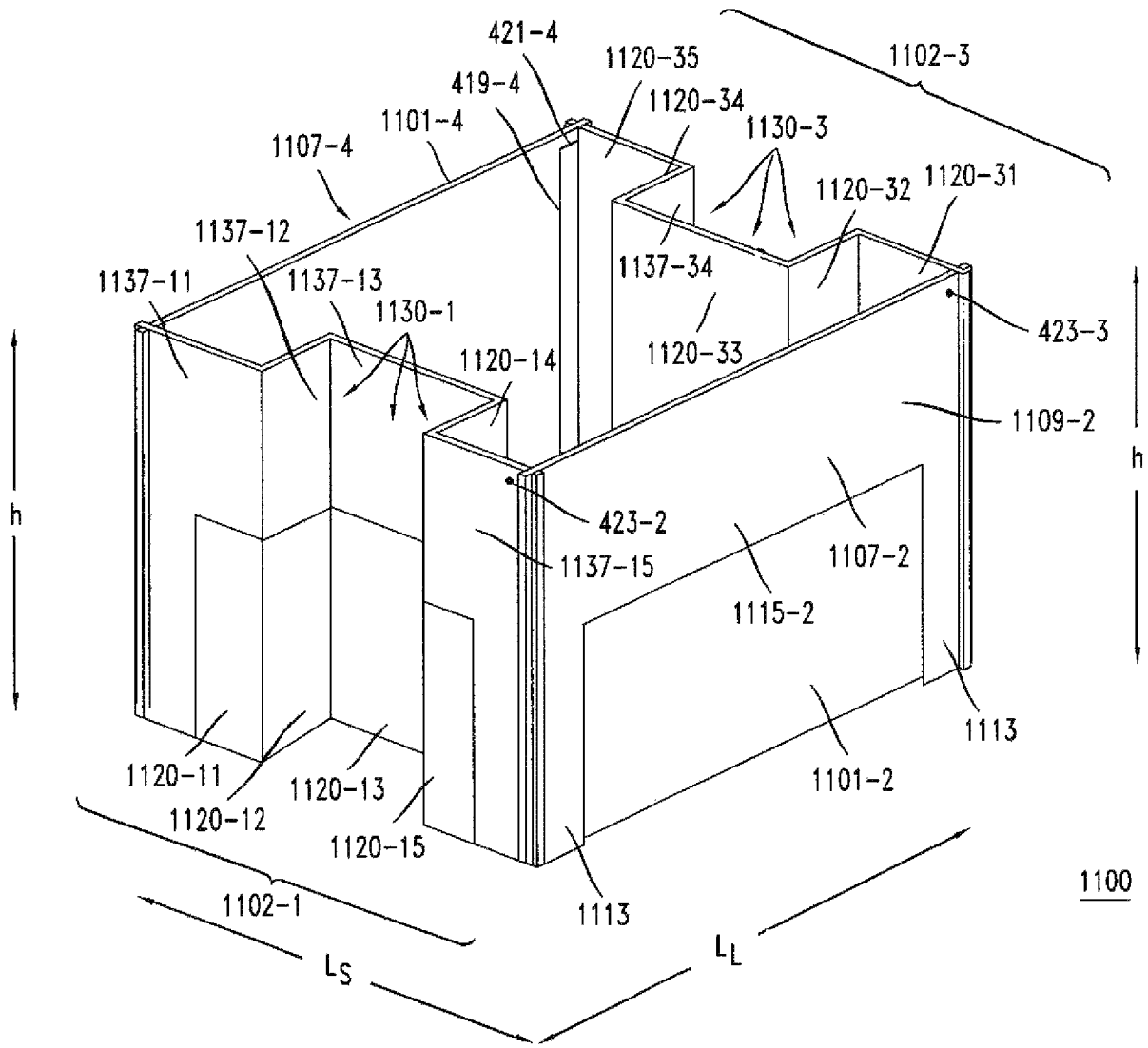
FIG. 11 shows an enlarged view of the structure of an illustrative LB antenna in which the vertical and horizontal branches, i.e., the physical support structure thereof, have different physical dimensions, e.g., lengths, but which have been arranged, in accordance with the principles of the disclosure, to have identical electrical lengths for their radiating elements by adding a chicane to each of those support elements of what would otherwise be the shorter radiating elements and each such radiating element is arranged to follow the chicane, thereby artificially increasing its electrical length.

FIG. 11 shows an enlarged view of the structure of an illustrative LB antenna 1100 which is similar to illustrative LB antenna 900 in that the vertical and horizontal branches, i.e., the physical support structure thereof, have different physical dimensions, e.g., lengths, but which have been arranged, in accordance with the principles of the disclosure, to have identical electrical lengths for the radiating elements notwithstanding the different physical dimensions of LB antenna 1100, e.g., the various portions of its support structure. In other words, LB antenna 1100 may have unequal separation between opposing supports, e.g., so that the LB antenna does not give the appearance of a square when looking toward the surface through which the 5G signal passes, while having identical electrical lengths for its radiating elements, in accordance with the principles of the disclosure. In accordance with an embodiment of the disclosure, to increase the electrical length of the radiating elements that run between opposing supports that are closer together, i.e., the conductors that run between supports that have a smaller distance between them, a chicane, e.g., a short section of wall such as with sharp narrow bends which may form a zig-zag or serpentine wall structure, such as in the manner shown, is added to each of those support elements of such radiating conductor and each such radiating conductor is arranged to follow the chicane, thereby artificially increasing its electrical length.

In accordance with an aspect of the disclosure, LB antenna 1100 may be a passive LB antenna.

LB antenna 1100 as shown in FIG. 11 may be made of two printed circuit boards (PCBs) 1101-2 and 1101-4, collectively circuit boards (PCBs) 1101, which are similar to PCBs 401-2 (FIG. 4) and 401-4. PCBs 1101 thus make up a first set of two parallel, opposing, flat rectangular substrate panels each having a height, a length, and a thickness for two of the radiating elements of LB antenna 1100 and also may be used at least partially to support a feed structure to supply one or more signals to the radiating elements.

At opposite ends of PCBs 1101 are support structures 1102-1 and 1102-3 which are, essentially, respective walls that each contain at least one of chicanes 1130-1 and 1130-3, and which may be referred to as such. Support structures 1102-1 and 1102-3 may be formed of several joined or interlocked circuit boards. In the manner shown, support side 1102-1 is formed of circuit boards 1120-11, 1120-12, 1120-13, 1120-14, and 1120-15 while support side 1102-3 is formed of circuit boards 1120-31, 1130-32, 1120-33, 1120-34, and 1120-35.

Printed circuit board 1101-2 may be joined or interlocked at its edges with circuit boards 1120-15 and 1120-31, respectively, while printed circuit board 1101-4 may be joined or interlocked at its edges with 1120-11 and 1120-35, respectively, e.g., in the manner described hereinabove.

Portions of ones of external surfaces 1107-2 and 1107-4 of respective ones of PCBs 1101 are coated in a conductive material, e.g., copper. Thus, in the embodiment shown in FIG. 11, inverted "U" shaped conductors 1109 are formed on surfaces 1107-2 and 1107-4 of respective ones of PCBs 1101-2 and 1101-4. Conductors 1109 are made up of leg portions 1113 and radiating portions 1115. Clearly depicted in FIG. 11 is conductor 1109-2. However, note that due to the orientation of LB antenna 1100 in FIG. 11 that surface 1107-4, although it can be indicated, is not clearly visible and so conductor 1109-4 is not visible in FIG. 11. Nevertheless, for purposes of the embodiment shown in FIG. 11, it has thereon the same conductor structure as conductor 1109-2.

In the embodiment shown in FIG. 11, all of the PCBs may have the same height h and thickness. However, long sides 1101-2 and 1101-4 each have length $L_L$ which is greater than the length $L_S$ of the direct orthogonal distance between 1101-2 and 1101-4. In other words, length $L_S$ is the length that would have resulted had walls with chicanes 1130 not had any chicanes but simply been straight walls. Conductors mounted on such straight walls in the manner that conductors 1109 are mounted on PCBs 1101 would have resulted in a radiating portion with an electrical length less than that of radiating portions 1115-2 and 1115-4. However, by having a radiating portion formed of the combined electrically coupled conductors 1137 that are on each of PCBs 1120 of each of walls with chicanes 1102 such that the combined radiating portion follows the path of the chicanes, the resulting electrical length of the combined radiating portions may be made equal to the electrical length of each of radiating portions 1115, in accordance with an aspect of the disclosure. Those of ordinary skill in the art will readily be able to design the chicanes so that the resulting radiating portions 1135 have the desired electrical length.

LB antenna 1100 may be electrically driven in the same manner as described hereinabove with regard to LB antenna 203. However, except for conductive line 419-4 and arm portion 421-4, in FIG. 11 the remaining driving structure is either not visible or not shown for clarity purposes.

Advantageously, LB antenna 1100 may accommodate 5G antennas that are arranged in a lattice design, e.g., where each column is shifted vertically by 0.35 lambda, lambda being an operating wavelength, with respect to its neighboring column.

Although chicanes 1130 are shown extending interiorly to the hollow box shape of LB antenna 1100, chicanes may be employed that extend exteriorly from the hollow box shape of an LB antenna. Furthermore, a combination of interiorly and exteriorly extending chicanes may be used as appropriate to any particular design.

Figure 12:
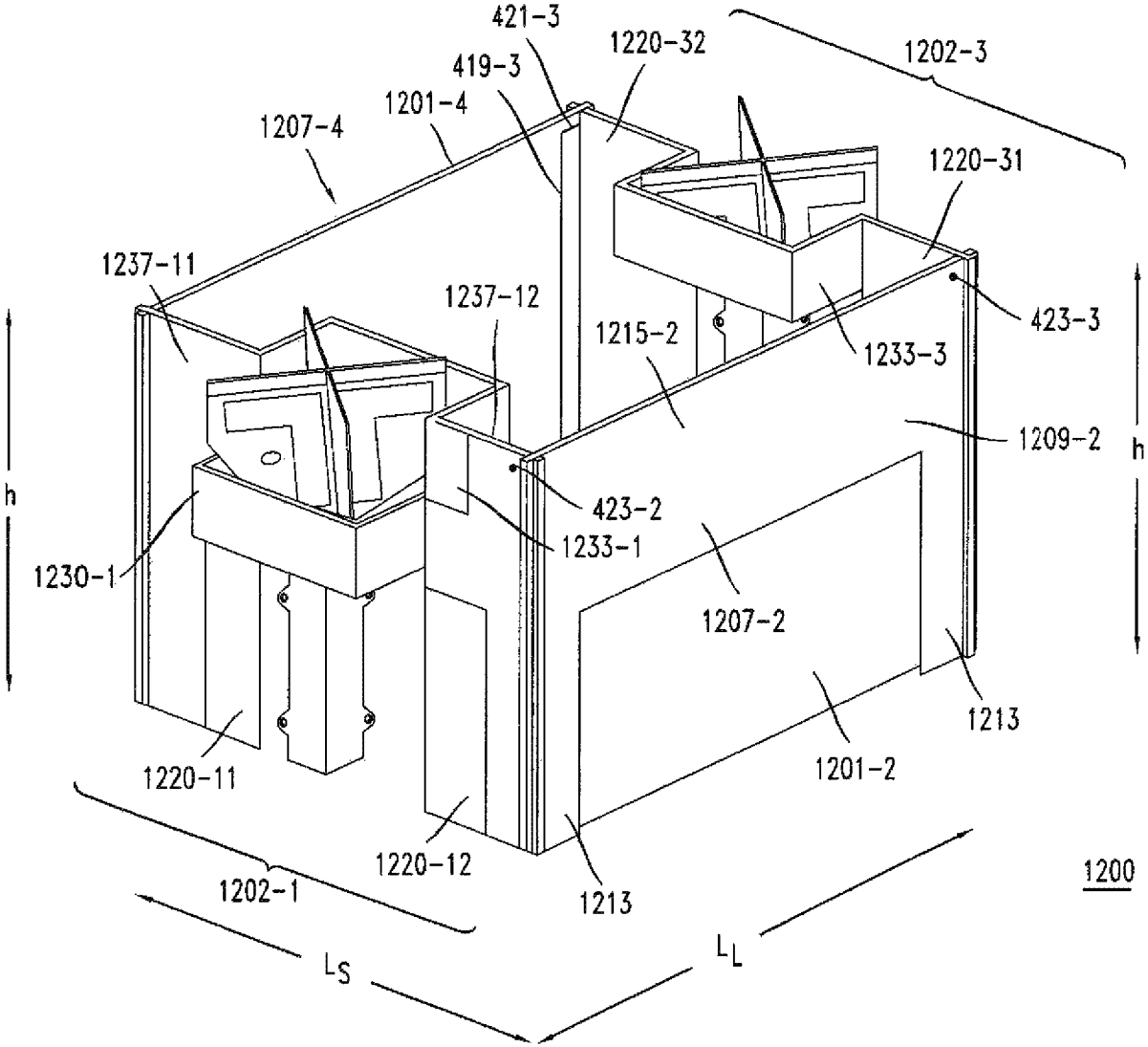
FIG. 12 shows an enlarged view of the structure of an illustrative LB antenna in which the vertical and horizontal branches, i.e., the physical support structure thereof, have different physical dimensions, e.g., lengths, but which have been arranged, in accordance with the principles of the disclosure, to have identical electrical lengths for their radiating elements by incorporating into the shorter radiating elements a conductor that goes around the reflector of a 5G radiating element, thereby artificially increasing its electrical length.

FIG. 12 shows an enlarged view of the structure of an illustrative LB antenna 1200 which is similar to illustrative LB antenna 1100 in that the vertical and horizontal branches, i.e., the physical support structure thereof, have different physical dimensions, e.g., lengths, but which have been arranged, in accordance with the principles of the disclosure, to have identical electrical lengths for the radiating elements notwithstanding the different physical dimensions of the LB antenna, e.g., the various portions of its support structure. In other words, LB antenna 1200 may have unequal separation between opposing supports, e.g., so that the LB antenna does not give the appearance of a square when looking toward the surface through which the 5G signal passes, while having identical electrical lengths for its radiating elements, in accordance with the principles of the disclosure. In accordance with an embodiment of the disclosure, to increase the electrical length of the radiating elements that run between opposing supports that are closer together, i.e., the conductors that run between supports that have a smaller distance between them, each such radiating conductor is arranged to incorporate a conductor shaped to go around part of a reflector of a 5G antenna, thereby artificially increasing its electrical length.

In accordance with an aspect of the disclosure, LB antenna 1200 may be a passive LB antenna.

LB antenna 1200 as shown in FIG. 12 may be made of two printed circuit boards (PCBs) 1201-2 and 1201-4, collectively circuit boards (PCBs) 1201, which are similar to PCBs 401-2 (FIG. 4) and 401-4. PCBs 1201 thus make up a first set of two parallel, opposing, flat rectangular substrate panels each having a height, a length, and a thickness for two of the radiating elements of LB antenna 1200 and also may be used to at least partially support a feed structure to supply one or more signals to the radiating elements.

At opposite ends of PCBs 1201 are support structures 1202-1 and 1202-3 which are, essentially, partial walls that have a gap between them and which incorporate a conductor 1233, e.g., conductors 1233-1 and 1233-3, which is shaped to go around part of a reflector of a 5G antenna, e.g., a respective one of 5G reflectors 1230-1 and 1230-3 (not visible), which protrudes within the gap between the partial walls. Support structures 1202-1 and 1202-3 may each be formed of two circuit boards. In the manner shown, support structure 1202-1 is formed of circuit boards 1220-11 and 1220-12 while support structure 1202-3 is formed of circuit boards 1220-31 and 1220-32. Conductor 1233-1, for example, is affixed so as to be held in place and electrically coupled between circuit boards 1220-11 and 1220-12, e.g., by soldering or any other suitable technique.

In the manner shown, printed circuit board 1201-2 may be joined or interlocked at its edges with circuit boards 1220-12 and 1220-31, respectively, while printed circuit board 1201-4 may be joined or interlocked at its edges with 1220-11 and 1220-32, respectively, e.g., in the manner described hereinabove.

Portions of ones of external surfaces 1207-2 and 1207-4 of respective ones of PCBs 1201 are coated in a conductive material, e.g., copper. Thus, in the embodiment shown in FIG. 12, inverted "U" shaped conductors 1209 are formed on surfaces 1207-2 and 1207-4 of respective ones of PCBs 1201-2 and 1201-4. Conductors 1209 are made up of leg portions 1213 and radiating portions 1215. Clearly depicted in FIG. 12 are conductors 1209-2. However, note that due to the orientation of LB antenna 1200 in FIG. 12 that surface 1207-4, although it can be indicated, is not clearly visible and so conductor 1209-4 is not visible in FIG. 12. Nevertheless, for purposes of the embodiment shown in FIG. 12, it has thereon the same conductor structure as conductor 1209-2.

In the embodiment shown in FIG. 12, all of the PCBs may have the same height h and thickness. However, long sides 1201-2 and 1201-4 each have length $L_L$ which is greater than the length $L_S$ of each of the direct orthogonal distance between PCBs 1201-2 and 1201-4. In other words, length $L_S$ is the length that would have resulted had support structures 1202 each simply been a straight wall. Conductors mounted on such straight walls in the manner that conductors 1209 are mounted on PCBs 1201 would have had a radiating portion with an electrical length less than that of radiating portions 1215-2 and 1215-4. However, by having a radiating portion formed of the combination of conductors 1237 that are on each of PCBs 1220 and also including at least a portion of one of conductors 1233 that goes around 5G reflectors 1230 in the conductive path between conductors 1237, the resulting combined electrical length of the radiating portions on the side of support structures 1202 may be made equal to the electrical length of each of radiating portions 1215, in accordance with an aspect of the disclosure. Those of ordinary skill in the art will readily be able to design the various conductors so as to achieve the desired electrical length.

LB antenna 1200 may be electrically driven in the same manner as described hereinabove with regard to LB antenna 203. However, except for conductive line 419-4 and arm portion 421-4, in FIG. 12 the remaining driving structure is either not visible or not shown for clarity purposes.

Advantageously, LB antenna 1200 may accommodate 5G antennas that are arranged in a lattice design, e.g., where each column is shifted vertically by 0.35 lambda, lambda being an operating wavelength, with respect to its neighboring column.

Although conductors 1233 are shown as having a rectangular shape, it will be readily recognized by those of ordinary skill in the art that other shapes, e.g., semicircular, arbitrary, and so forth, may be employed. Although conductors 1233 are shown extending interiorly to the hollow box shape of LB antenna 1100, conductors 1233 may be employed that extend exteriorly from the hollow box shape of an LB antenna. Furthermore, a combination of interiorly and exteriorly extending conductors 1233 may be used as appropriate to any particular design.

Figure 13:
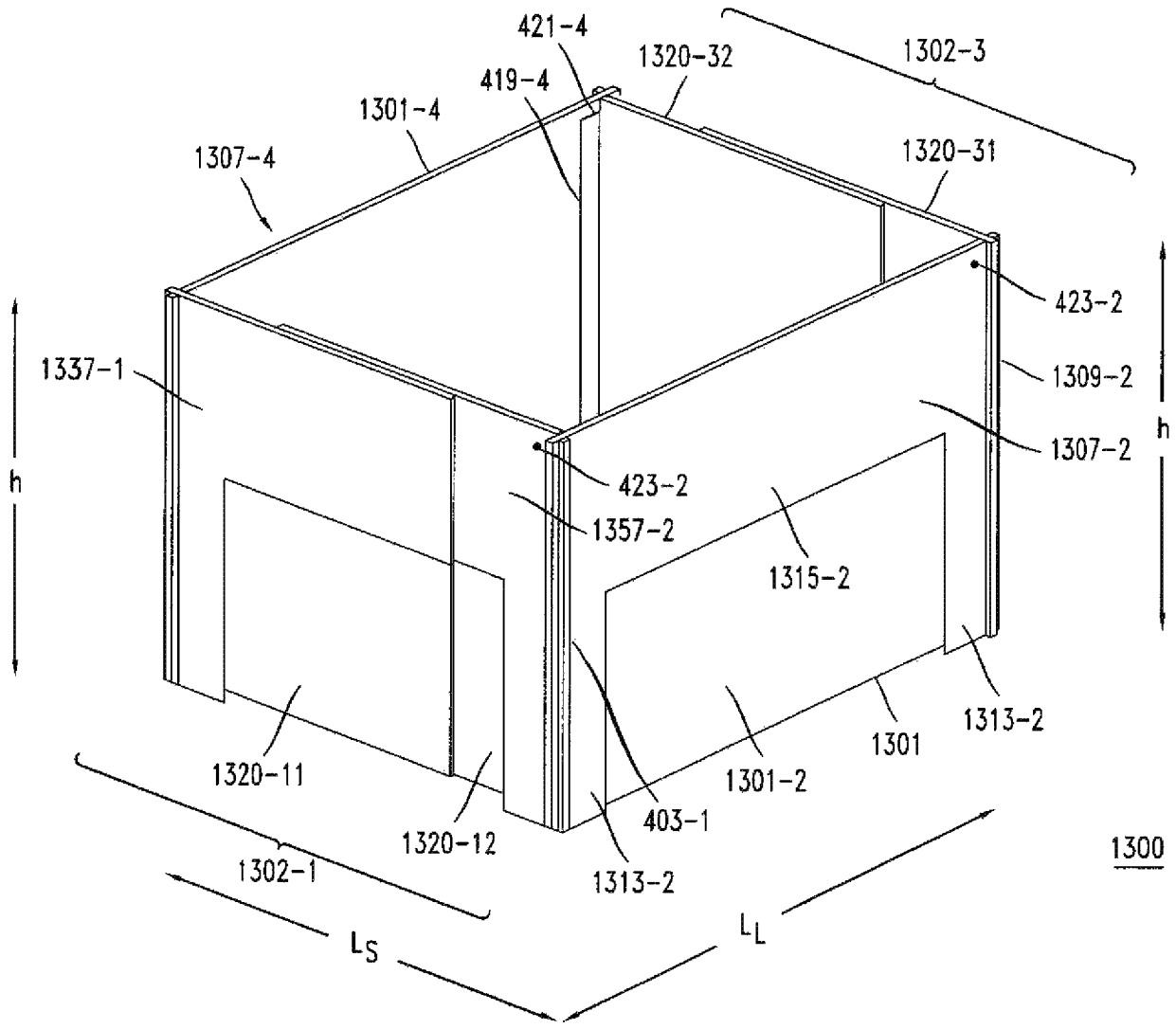
FIG. 13 shows an enlarged view of the structure of an illustrative LB antenna in which the vertical and horizontal branches, i.e., the physical support structure thereof, have different physical dimensions, e.g., lengths, but which have been arranged, in accordance with the principles of the disclosure, to have identical electrical lengths by incorporating additional capacitive coupling for the radiators along the shorter physical dimension.

FIG. 13 shows an enlarged view of the structure of an illustrative LB antenna 1300 in which the vertical and horizontal branches, i.e., the physical support structure thereof, have different physical dimensions, e.g., lengths, but which have been arranged, in accordance with the principles of the disclosure, to have identical electrical lengths for the radiating elements notwithstanding the different physical dimensions of the LB antenna, e.g., the various portions of its support structure. In other words, LB antenna 1300 may have unequal separation between opposing supports, e.g., so that the LB antenna does not give the appearance of a square when looking toward the surface through which the 5G signal passes, while having identical electrical lengths for the radiating elements, in accordance with the principles of the disclosure. In accordance with an embodiment of the disclosure, to increase the electrical length of the radiating elements that run between opposing supports that are closer together, i.e., the conductors that run between supports that have a smaller distance between them, each such radiating conductor is split into two sections and arranged to incorporate capacitive coupling between the two sections, thereby artificially increasing its electrical length.

In accordance with an aspect of the disclosure, LB antenna 1300 may be a passive LB antenna.

LB antenna 1300 as shown in FIG. 13 may be made of two printed circuit boards (PCBs) 1301-2 and 1301-4, collectively circuit boards (PCBs) 1301, which are similar to PCBs 401-2 (FIG. 4) and 401-4. PCBs 1301 thus make up a first set of two parallel, opposing, flat rectangular substrate panels each having a height, a length, and a thickness for two of the radiating elements of LB antenna 1300 and also may be used to at least partially support a feed structure to supply one or more signals to the radiating elements.

At opposite ends of PCBs 1301 are support structures 1302-1 and 1302-3 which are overlapping partial walls. Support structures 1302-1 and 1302-3 may each be formed of two circuit boards. In the manner shown, support structure 1302-1 is formed of circuit boards 1320-11 and 1320-12 while support side 1302-3 is formed of circuit boards 1320-31 and 1320-32. Circuit boards 1320-11 and 1320-12 are the overlapping partial walls of support structure 1302-1 while support circuit boards 1320-31 and 1320-32 are the overlapping partial walls of support structure 1302-3.

In the manner shown, printed circuit board 1301-2 may be joined or interlocked at its edges with circuit boards 1320-12 and 1320-31, respectively, while printed circuit board 1301-4 may be joined or interlocked at its edges with 1320-11 and 1320-32, respectively, e.g., in the manner described hereinabove.

Portions of ones of external surfaces 1307-2 and 1307-4 of respective ones of PCBs 1301 are coated in a conductive material, e.g., copper. Thus, in the embodiment shown in FIG. 13, inverted "U" shaped conductors 1309 are formed on surfaces 1307-2 and 1307-4 of respective ones of PCBs 1301-2 and 1301-4. Conductors 1309 are made up of leg portions 1313 and radiating portions 1315. Clearly depicted in FIG. 13 are conductors 1309-2. However, note that due to the orientation of LB antenna 1300 in FIG. 13 that surface 1307-4, although it can be indicated, is not clearly visible and so conductor 1309-4 is not visible in FIG. 13. Nevertheless, for purposes of the embodiment shown in FIG. 13, it has thereon the same conductor structure as conductor 1309-2.

In the embodiment shown in FIG. 13, all of the PCBs may have the same height, h, and thickness. However, long sides 1301-2 and 1301-4 each have length $L_L$ which is greater than the length $L_S$ of the direct orthogonal distance between 1301-2 and 1301-4. In other words, length $L_S$ is the length that would have resulted had support structures 1302 each simply been a straight continuous wall. Conductors mounted on such straight walls in the manner that conductors 1309 are mounted on PCBs 1301 would have resulted in a radiating portion with an electrical length less than that of radiating portions 1315-2 and 1315-4. However, by having radiating portions formed of conductors 1337 that are on each of the PCBs 1320 but arranged so that portions of conductors 1337 overlap each other, the resulting capacitive coupling changes the electrical length of the combined radiating portion on the side of support structures 1302 which may be made equal to the electrical length of each of radiating portions 1315, in accordance with an aspect of the disclosure, by appropriate selection of the overlapping length. Those of ordinary skill in the art will readily be able to design the various conductors and reflectors so as to achieve the desired electrical length.

The use of capacitive coupling means that there is no physical coupling between the portions of conductors 1337 that overlap each other.

LB antenna 1300 may be electrically driven in the same manner as described hereinabove with regard to LB antenna 203. However, except for conductive line 419-4 and arm portion 421-4, in FIG. 13 the remaining driving structure is either not visible or not shown for clarity purposes.

Although in FIGS. 9 through 13 the various substrates have been described hereinabove as being PCBs, note that in other embodiments of the disclosure, any dielectric material, e.g., ceramic, glass, plastic, and so forth, that could be properly shaped and support properly shaped conductors may be employed as a substrate.

As with FIG. 4, also in FIGS. 9 through 13 portions any of the substrates that are not coated in conductive material are not necessary and may be eliminated, e.g., to reduce weight. Again, note that due to the orientation of the various embodiments, had such unused portions been removed that may not have be visible in the various FIGs.

Any of the various techniques provided above for lengthening the radiator along the sides with the shorter physical distance between them may be combined to arrive at the desired overall electrical length. Furthermore, it should be noted that in view of the goal, in accordance with the principles of the invention, of insuring that the physically shorter and physically longer sides have the same electrical length, given the often unavoidable physical limitations of real systems, it may be necessary to arrange the electrical length of the longer side, e.g., using the above described techniques, in order to properly set its electrical length so that it may be matched by a corresponding modified electrical length of the shorter side. Thus, for example, the shorter sides may incorporate a conductor to go around a 5G antenna while the longer side may have a slight zig-zag so as to arrive at both sides having an equal electrical length.

What is claimed is:

1. An antenna, comprising:

a non-square rectangular arrangement of substrate panels, including a first pair of substrate panels having a height, a length, and a thickness, the first pair of substrate panels disposed in a parallel, spaced apart relationship to form a first pair of opposing vertical walls of the non-square rectangular arrangement, wherein a conductor is disposed on an external surface of each substrate panel of the first pair of substrate panels, each conductor having a physical length that extends along the length of the respective substrate panel such that the conductor disposed on the external surface of a respective substrate panel has a same, first electrical length;

a second pair of substrate panels having physical dimensions different from the first pair of substrate panels, the second pair of substrate panels disposed in a parallel, spaced apart relationship to form a second pair of opposing vertical walls of the non-square rectangular arrangement, wherein a conductor is disposed on an external surface of each substrate panel of the second pair of substrate panels, wherein the conductors disposed on the second pair of substrate panels are arranged to have substantially the same, first electrical length as each of the conductors disposed on the first pair of substrate panels.

2. The antenna as defined in claim 1 wherein at least one of the conductors disposed on the second pair of substrate panels has a dielectric material coupled thereto so as to change its electrical length to be substantially equal to that of at least one of the conductors disposed on the first pair of substrate panels.

3. The antenna as defined in claim 1 wherein at least one of the conductors disposed on the second pair of substrate panels has a zig-zag or serpentine shape so that its electrical length is substantially equal to that of at least one of the conductors disposed on the first pair of substrate panels.

4. The antenna as defined in claim 1 wherein at least one of the second pair of support panels has at least one chicane, at least one of the conductors disposed on the second pair of support panels following a path of the at least one chicane as it runs between the first pair of support panels so that the electrical length of the conductor disposed on the at least one of the second pair of support panels including the chicane is substantially equal to that of at least one of the conductors disposed on the first pair of support panels.

5. The antenna as defined in claim 1 wherein at least one of the conductors disposed on the air of second support incorporates a conductor that goes around at least a part of a reflector for a fifth generation-5G-antenna for broadband cellular networks.

6. The antenna as defined in claim 1 wherein at least one of the conductors supported by the second pair of support panels is divided into at least two portions, each of the two portions being electrically connected by a conductor that goes around at least a part of a reflector for a fifth generation-5G-antenna for broadband cellular networks.

7. The antenna as defined in claim 1 wherein the antenna is a multiband antenna.

8. The antenna as defined in claim 7 wherein the multiband antenna is a passive antenna.

9. The antenna as defined in claim 7 wherein the multiband antenna is a low band (LB) antenna.

10. A multiband antenna adapted to be interleaved amongst a two-dimensional array of fifth generation-5G-antennas, wherein the multiband antenna is shaped substantially like a hollow, non-square parallelepiped with two opposing surfaces missing, wherein one of the missing surfaces is proximal to a source of a signal that is supplied to the multiband antenna to be transmitted therefrom and the opposing missing surface is distal to the signal source;

wherein the hollow, non-square parallelepiped comprises a first pair of opposing support walls, each respective support wall of the first pair having a thickness that fits within a gap between at least two of the 5G antennas, the first pair of support walls having a first physical distance between them, and a second pair of opposing support walls having a second physical distance between them, the first physical distance being different from the second physical distance;

each of the support walls supporting a conductor for radiating therefrom; and wherein an electrical length of each of the conductors for radiating supported on each respective support wall of the first pair of support walls is adapted to be equal to the electrical length of each of the conductors for radiating supported on each respective support wall of the second pair of support walls.

11. The multiband antenna as defined in claim 10 wherein the hollow non-square parallelepiped is a cuboid but not a cube.

12. The multiband antenna as defined in claim 10 wherein the electrical length of each of the conductors for radiating supported on each respective support wall of the first pair of support walls is adapted by having thereon a dielectric material.

13. The multiband antenna as defined in claim 10 wherein the electrical length of each of the conductors for radiating supported on each respective support wall of the first pair of support walls is adapted by having a zig-zag or a serpentine shape.

14. The multiband antenna as defined in claim 10 wherein each wall of the first pair of support walls is made up of at least two separate support wall portions, a first support wall portion supporting a first portion of the conductor and at least a second support wall portion supporting a second portion of the conductor; and wherein the electrical length of each of the conductor for radiating supported by its respective wall of the first pair is adapted by overlapping the first and second portions of the conductor for radiating supported by its respective wall portions.

15. A multiband antenna adapted to be interleaved amongst a two-dimensional array of fifth generation (5G) antennas, wherein the multiband antenna is shaped substantially like a hollow, non-square parallelepiped with two opposing surfaces missing, wherein one of the missing surfaces is proximal to a source of a signal that is supplied to the multiband antenna to be transmitted therefrom and the opposing missing surface is distal to the signal source;

wherein the hollow, non-square parallelepiped comprises a first pair of opposing support walls, each respective support wall of the first pair having a thickness that fits within a gap between at least two of the 5G antennas contained within the two-dimensional array of 5G antennas, and the first par of support walls having a first physical distance between them, and a second pair of opposing support walls having a second physical distance between them, the first physical distance being different from the second physical distance;

each of the support walls supporting a conductor for radiating therefrom;

wherein each wall of the first pair of support walls is made up of at least two support wall portions, each support wall portion supporting a separate portion of the conductor for radiating supported by its respective wall of the first pair group, a gap existing in each supporting wall of the first pair between the at least two support wall portions, each gap being bridged by at least one bridging conductor that is included as part of the conductor for radiating supported by its respective wall of the first pair; and wherein the electrical length of each of the conductors for radiating supported by each respective support wall of the first pair of support walls is adapted to be equal to the electrical length of each of the conductors for radiating supported on each respective support wall of the second pair of support walls.

16. The antenna as defined in claim 15 wherein at least one bridging conductor is shaped to go around part of a respective reflector for a 5G antenna entering at least in part into the respective gap.

17. The antenna as defined in claim 15 wherein at least one bridging conductor is supported to follow contours of a chicane located in the respective gap.

18. The antenna as defined in claim 15 wherein at least one bridging conductor is supported to follow contours of a chicane located in the respective gap, the chicane being made up of the same materials as the wall portions.

19. The antenna as defined in claim 15 wherein the antennas of the two-dimensional array of 5G antennas are arranged in a lattice design.

20. The antenna as defined in claim 15 wherein the antennas of the two-dimensional array of 5G antennas are arranged in a lattice design such each column is shifted vertically by with respect to its neighboring column.

* * * * *